US007642024B2

(12) United States Patent
Furuya

(10) Patent No.: US 7,642,024 B2
(45) Date of Patent: Jan. 5, 2010

(54) IMAGE-FORMING APPARATUS AND IMAGE-FORMING PROCESS

(75) Inventor: Nobumasa Furuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 501 days.

(21) Appl. No.: 11/603,980

(22) Filed: Nov. 24, 2006

(65) Prior Publication Data

US 2008/0008487 A1 Jan. 10, 2008

(30) Foreign Application Priority Data

Jul. 5, 2006 (JP) ..... 2006-185274

(51) Int. Cl.
*G03G 15/16* (2006.01)

(52) U.S. Cl. ..... 430/56; 399/51; 399/53

(58) Field of Classification Search ..... 430/56; 399/51, 53

See application file for complete search history.

(56) References Cited

FOREIGN PATENT DOCUMENTS

| | | |
|---|---|---|
| JP | A-63-311364 | 12/1998 |
| JP | A-2003-330228 | 11/2003 |

OTHER PUBLICATIONS

Unpublished U.S. Appl. No. 11/603,842, filed Nov. 24, 2006 (Kimura et al.).
Unpublished U.S. Appl. No. 11/603,979, filed Nov. 24, 2006 (Maeyama).
Unpublished U.S. Appl. No. 11/604,024, filed Nov. 24, 2006 (Hara et al.).
Unpublished U.S. Appl. No. 11/604,025, filed Nov. 24, 2006 (Kashimura).
Unpublished U.S. Appl. No. 11/604,031, filed Nov. 24, 2006 (Ito).
Unpublished U.S. Appl. No. 11/604,036, filed Nov. 24, 2006 (Kimura et al.).
Unpublished U.S. Appl. No. 11/604,044, filed Nov. 24, 2006 (Ito).
Unpublished U.S. Appl. No. 11/604,048, filed Nov. 24, 2006 (Kimura et al.).
Unpublished U.S. Appl. No. 11/604,049, filed Nov. 24, 2006 (Takegawa).

*Primary Examiner*—Hoa V Le
(74) *Attorney, Agent, or Firm*—Morgan, Lewis & Bockius LLP

(57) ABSTRACT

An image-forming apparatus comprises: an image carrier; a charging unit; a latent image forming unit; a developing unit that uses a toner maintaining a non-color-developing state when provided with coloring information through exposure to light; a coloring information providing unit that provides the toner image with coloring information by exposing the toner image to light having a predetermined wavelength determined depending on the color not to be developed based on color component information of image data; a transfer unit; a fixing unit; a color-developing unit that develops a color of the toner image provided with the coloring information; and a control unit that controls the coloring information providing unit to expose a background region on the image carrier to light having a predetermined wavelength for preventing color development of the toner.

11 Claims, 10 Drawing Sheets

IMAGE-FORMING APPARATUS AND IMAGE-FORMING PROCESS

BACKGROUND

1. Technical Field

The present invention relates to an image-forming apparatus and an image-forming process.

2. Related Art

In conventional electrophotographic color-image recording devices, images in basic three primary colors are developed respectively according to image information, and these toner images are stacked one by one for obtaining a color image. Specifically, the following apparatus structures are known: so-called four-cycle machines that form a color image by developing a toner image in each color on a photosensitive drum carrying a latent image formed by an image-forming method and repeating transfer of the toner image in each color onto a transfer member; and tandem machines which have image-forming units in the respective colors each having a photosensitive drum and a developing device and which obtain a color image by transferring the toner images onto a traveling transfer member one by one.

These machines are common at least in that they have multiple developing devices for different colors. Accordingly, four developing devices for three primary colors and black are necessary for usual color image formation. In the tandem machines, it is necessary to provide four photosensitive drums corresponding to four developing devices and also a means for synchronizing the four image-forming units; therefore, increase in the size of the machines and in the cost is inevitable.

SUMMARY

According to an aspect of the present invention, an image-forming apparatus comprises:

an image carrier, a charging unit that charges the image carrier to a predetermined electric potential, a latent image forming unit that forms an electrostatic latent image corresponding to image data on the image carrier by exposing the image carrier charged by the charging unit to light, a developing unit that stores a toner, develops the electrostatic latent image formed on the image carrier with the toner, and forms a toner image on the image carrier, the toner maintaining a non-color-developing state by being provided with coloring information through exposure to light, a coloring information providing unit that provides the toner image with coloring information by exposing the toner image to light having a predetermined wavelength determined depending on the color not to be developed based on color component information of the image data, a transfer unit that transfers the toner image onto a recording medium, a fixing unit that fixes the toner image on the recording medium, a color-developing unit that develops a color of the toner image provided with the coloring information, and a control unit that controls the coloring information providing unit to expose the background region on the image carrier to light having a predetermined wavelength for preventing the color development of the toner, the background region being a region other than an image region that the toner image is formed on.

BRIEF DESCRIPTION OF THE DRAWINGS

Exemplary embodiments of the present invention will be described in detail based on the following figures, wherein:

FIG. 6A is a view illustrating a color-developing region and 6B is an expanded view thereof;

DETAILED DESCRIPTION

Figure 1:
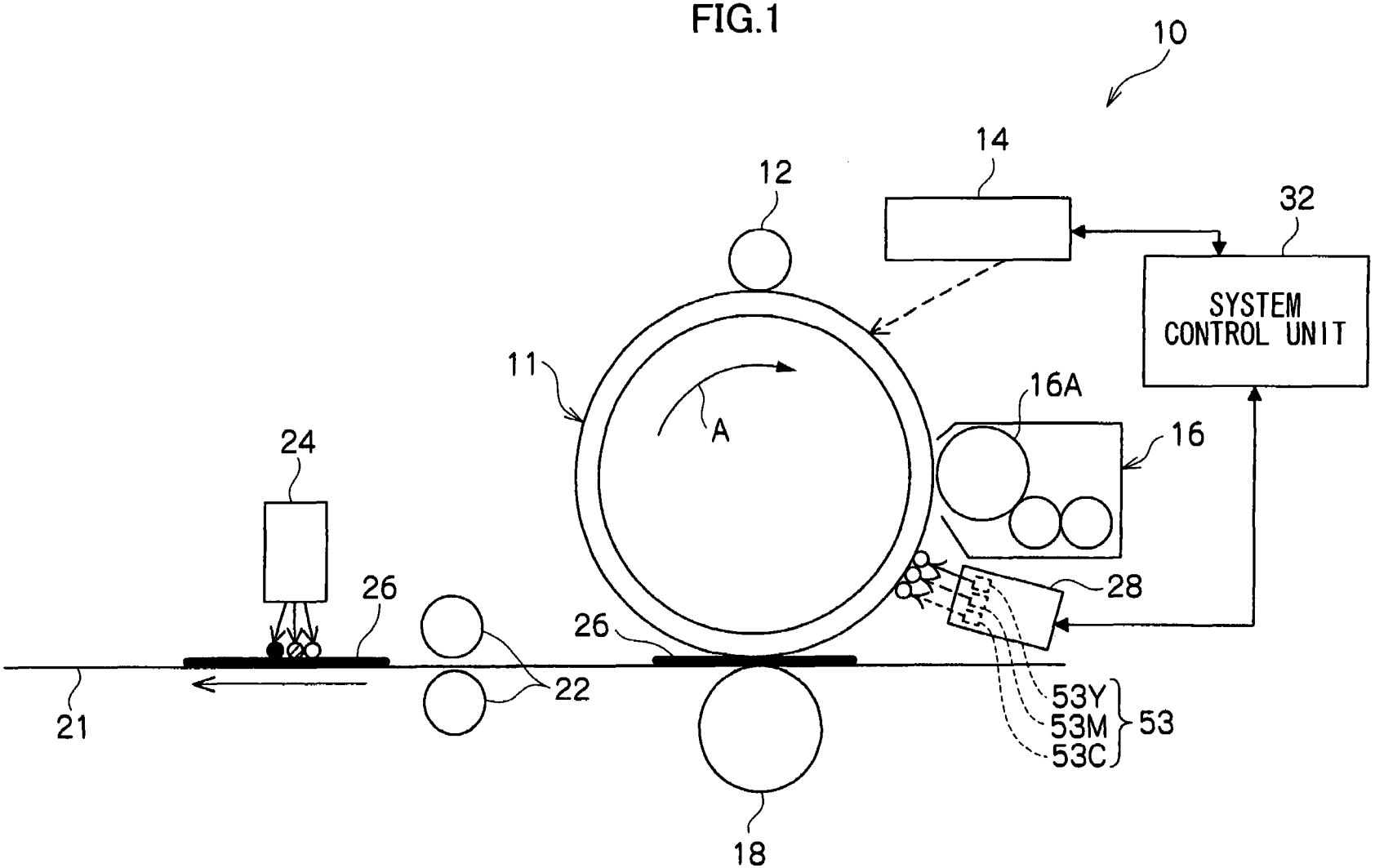
FIG. 1 is a schematic view illustrating the configuration of an example of an image-forming apparatus according to an aspect of the present invention.

Hereinafter, aspects of the present invention will be described in detail.

The image-forming apparatus according to an aspect of the present invention is an image-forming apparatus using a toner that maintains a non-color-developing state after coloring information is provided to the toner by light.

The toner for use in aspects of the present invention is a toner having a function, for example, to maintain a (non-colored) state at which the toner does not develop the color determined depending on the wavelength of the exposure light after each toner particle is exposed to light different in wavelength. The inside of the toner contains a color-developing substance that can develop color (and a color-developing region containing the same), and the toner is controlled to maintain the non-color-developing state by being provided with coloring information through exposure to light.

The expression "coloring information is provided by light" means that a desired region of a toner image is exposed selectively to one or more lights having particular wavelengths or the desired region is not exposed to any light, so as to control the non-color-developing state of individual toner particles or so as to control the color tone of the individual toner particles when the toner particles are colored.

When coloring information is provided by light exposure, the toner particles constituting the toner image maintain the non-color-developing state that does not develop the color determined depending on the wavelength of the exposure light.

The toner contains at least two kinds of reactive components (hereinafter, referred to as first and second components) that develop color through reaction with each other as a color-developing substance and a color-developing region containing the color-developing substance, which will be described later. The toner maintains the non-color-developing state when coloring information is provided by light, and develops color when heated.

In the toner, the first and second components are contained in separate matrices, so that diffusion therebetween is difficult unless coloring information is provided. In other words, the first and second components are separated from each other.

Specifically, the first component is contained in a first matrix; and the second component is contained in a matrix (second matrix) other than the first matrix. There may be a barrier between the first and second matrices, the barrier having a function of prohibiting diffusion of substances between the matrices and a function of allowing, when an external stimulus such as heat is applied, diffusion of substances between the matrices according to the type, strength, and combination of the stimuli.

As the barrier used for placing the two kinds of reactive components in the toner, it is preferable to use microcapsules. In an exemplary embodiment, in the toner, one of the two kinds of reactive components (the first or second component) is contained in microcapsules and the other component is contained outside the microcapsules.

When the first component is contained in microcapsules and the second component is contained outside the microcapsules, the interior of the microcapsules is the first matrix and outside of the microcapsules is the second matrix.

The microcapsules, which have a core region and a shell covering the core region, are not particularly limited as long as they have a function of prohibiting diffusion of substances inward or outward through the microcapsules unless an external stimulus such as heat is applied and allowing diffusion of substances inward or outward through the microcapsule when such an external stimulus applied, the allowance of the diffusion being in accordance with the type, strength, and combination of the stimuli. At least one of the reactive components is contained in the core region.

The microcapsules may be microcapsules that allow diffusion of substances inward or outward through the microcapsules upon application of stimulus such as light or pressure, or may be heat-responsive microcapsules that allow diffusion of substances inward or outward through the microcapsules upon heat treatment (through increase in the substance permeability of the shell).

The diffusion of substances inward or outward through the microcapsules upon application of a stimulus is preferably irreversible from the viewpoints of preventing decrease in the color density during image formation and change in color balance of the image left under a high-temperature environment.

Accordingly, the shell of the microcapsules may have a function of increasing its substance permeability irreversibly, for example, by softening, decomposition, dissolution (into a surrounding material), or deformation caused by application of a stimulus such as heat treatment or irradiation of light.

The toner for use in aspects of the present invention is not particularly limited if it has the functions above, and examples thereof include the toners described in JP-A Nos. 63-311364 and 2003-330228. The following toner may be used for increasing the amount of microcapsules in the toner and preventing uneven distribution of the microcapsules.

As described above in an aspect of the present invention, it is preferable to use a toner (hereinafter, occasionally referred to as "F toner") as the toner maintaining the color-developing or non-color-developing state when coloring information is provided by light, the F toner containing the first and second components which are separated from each other and which develop color through reaction with each other and a photocurable composition containing one of the first and second components, wherein the photocurable composition maintains the color-developing or non-color-developing state depending on whether the photocurable composition maintains the cured or uncured state when coloring information is provided by light.

First, the mechanism of the color development of the F toner for use in an aspect of the present invention will be described. The toner according to an aspect of the present invention has one or more continuous regions in a binder resin, called color-developing regions, that can maintain a state developing a particular color or a state not developing a particular color (i.e., non-color-developing state) after coloring information is provided by light, as will be described below.

When there are multiple color-developing regions in the toner, the multiple color-developing regions are disposed separately, so that the materials contained in the respective color-developing regions are not mixed with each other.

Thus, the toner according to an aspect of the present invention has one or plural color-developing regions, which are continuous regions that are capable of maintaining a state at which color can be developed or a non-color-developing state. When color is developed, the color of each region is different. As shown in FIG. 6A, each color-developing region 60 contains microcapsules 50 containing a coloring agent and a photocurable composition 58 surrounding the microcapsules 50. Thus, in the color-developing region 60, the microcapsules 50 are dispersed in the photocurable composition 58.

Figure 6B:
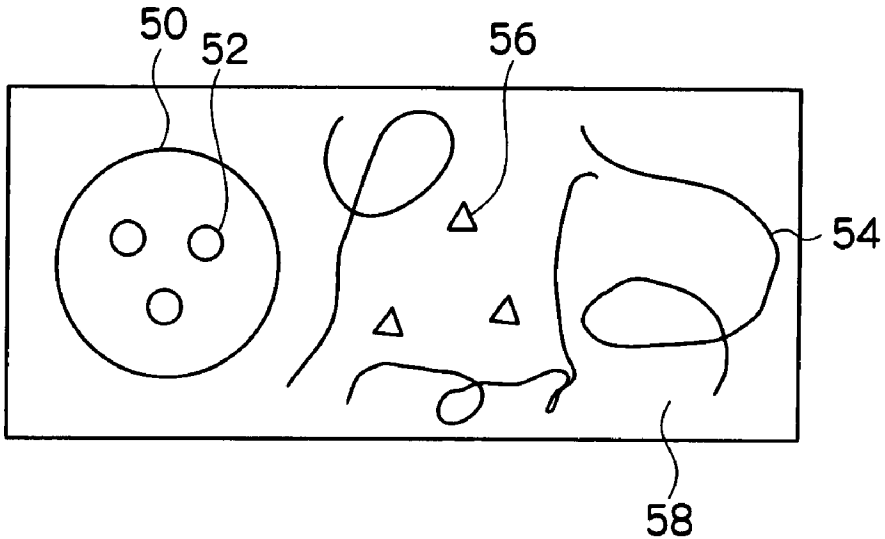
FIGS. 6A and 6B are schematic views showing a mechanism of color development of toner.
Figure 6A:
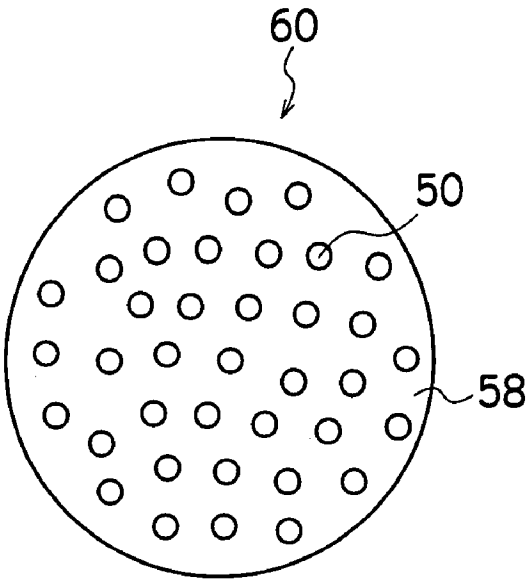

As shown in FIG. 6B, which is an expanded view illustrating the color-developing region 60, the color-developing region 60 contains at least microcapsules 50, a coloring agent (first component) 52, a developer monomer having a polymerizable functional group (second component) 54 that causes color formation when it comes close to or in contact with the coloring agent 52, and a photopolymerization initiator 56.

The microcapsules 50 contain at least a coloring agent (first component) 52 inside. The photocurable composition 58 surrounding the microcapsules 50 contains a developer monomer (second component) 54 having a polymerizable functional group that cause color formation when it comes close to or in contact with the coloring agent (first component) 52, and a photopolymerization initiator 56.

Triaryl-based leuco compounds superior in vividness of color tone, for example, are favorable as the coloring agents (first components) 52.

The developer monomer 54 developing the color of a coloring agent 52 such as the leuco compound (electron-donating compound) may be an electron-accepting compound. The developer monomer 54 is generally a phenol compound and selected properly from the developers used, for example, in thermosensitive and pressure-sensitive papers.

The coloring agent 52 develops color in acid base reaction between the electron-donating coloring agent 52 and the electron-accepting developer monomer 54.

The photopolymerization initiator 56 used is a spectral sensitizing colorant which is sensitive to visible light and which, upon irradiation with visible light, generates a polymerizing radical that triggers polymerization of the developer monomer 54.

For example, a reaction accelerator for the photopolymerization initiator 56 may be used for allowing the polymerization reaction of the developer monomer 54 to a sufficient degree upon irradiation of light in three primary colors, R, G, or B. For example, when an ion complex between a spectral sensitizing colorant (cation) absorbing irradiated light and a boron compound (anion) is used, the spectral sensitizing colorant is photoexcited by light exposure, transferring an electron to the boron compound, thus generating a polymerizable radical and initiating polymerization.

By combined used of these materials, it is possible to make the photosensitive color-developing region 60 have a coloring recording sensitivity of approximately 0.1 to 0.2 $mJ/cm^2$.

The color-developing region 60 in such a configuration contains a polymerized developer compound or an unpolymerized developer monomer 54, depending on whether the color-developing region 60 has been irradiated with light that provides coloring information to the color-developing region 60.

When a color-developing region containing unpolymerized developer monomer 54 is heated after the coloring information is provided, the developer monomer 54 migrates and penetrates through the pore of the microcapsule 50 wall, and diffuses into the interior of the microcapsule. When the developer monomer 54 is diffused into the interior of the microcapsule 50, the coloring agent 52 develop color through an acid-base reaction between the coloring agent 52 (basic) and the developer monomer 54 (acidic).

On the other hand, if the developer compound is polymerized, the developer compound, when subjected to a coloring step such as heating, cannot penetrate the pore of the microcapsule 50 wall by diffusion because of the bulkiness of the polymerized compound; therefore, the developer compound cannot react with the coloring agent 52 in the microcapsule and coloration does not occur. As a result, the microcapsule 50 remains colorless. Thus, the color-developing region 60 irradiated with light at a particular wavelength remains uncolored.

The entire surface is exposed to a white light source once again in a suitable stage after color development, thereby fixing the image reliably by polymerizing all residual unpolymerized developer monomers 54 and also, decolorizing the background color by decomposing the residual spectral sensitizing colorant. Although the color tone of a spectral sensitizing colorant of a photopolymerization initiator 56 for the visible light region remains consistently as the background color, a photodecolorization phenomenon of colorant/boron compounds may be used for decoloration of the spectral sensitizing colorant. That is, electron transfer from an photoexcited spectral sensitizing colorant to a boron compound generates a polymerizable radical, which initiates polymerization of monomer and also leads to decomposition of the colorant in reaction with an excited colorant radical and consequently to decoloration of the colorant.

In the F toner, the color-developing regions 60 different in the color to be developed (for example, continuous region capable of developing respective colors, Y, M, and C) may be contained in one microcapsule in the state that respective developer monomers 54 do not interfere with the coloring agents other than the target coloring agent 52 (mutually separated state). When there are multiple color-developing regions containing coloring agents 52 that develop different colors from each other in the same toner, the multiple color-developing regions are separated from each other such that the materials contained in the respective color-developing regions are not mixed.

In the toner, the space in the color-developing region 60 other than the microcapsules 50 containing an electron-donating coloring agent 52 is filled with an electron-accepting developer monomer 54 and a photocurable composition 58. The light-receiving efficiency per particle is drastically higher than that of the toner disclosed in JP-A No. 2003-330228 because such a color-developing region 60 is irradiated with light.

Advantageously, because the coloring information providing mechanism is not a reversible reaction as described above, there is no restriction on the time that elapses before coloration occurs by heating. As a result, it is possible to print in the low speed range, i.e., to cope with a wider speed range; and additionally there is a higher degree of freedom in designing the location, for example, of the fixing unit for developing color by heating.

The F toner for use in an aspect of the present invention will be described below in more detail.

Examples of the F toner for use in an aspect of the present invention include the following three toners: The F toner may be a toner containing i) first and second components that develop color through reaction therebetween, ii) a photocurable composition, and iii) microcapsules dispersed in the photocurable composition, wherein the first component is contained in the microcapsules and the second component is contained in the photocurable composition (first aspect), ii) a toner containing i) first and second components that develop color through reaction therebetween and ii) microcapsules containing a photocurable composition, wherein the first component is contained outside the microcapsule and the second component is contained in the photocurable composition (second aspect), or iii) a toner containing i) first and second components that develop color through reaction therebetween, ii) first microcapsules containing the first component, and iii) second microcapsules containing a photocurable composition containing the dispersed second component (third aspect).

Among the three aspects, the first aspect is preferable, from the viewpoints of the stability before coloring information is provided by light, controllability of color development, and others. In the following description of the toner, the toner in the first aspect will be basically described in detail, but the configuration, materials, production method, and others of the toner in the first aspect described below are also usable in and applicable to the toners in the second and third aspects.

The F toner described above in which a combination of heat-responsive microcapsules and a photocurable composition is used may be a toner having the following properties.

In this toner, diffusion of the second component contained in the uncured photocurable composition is accelerated upon heat treatment of the toner if the photocurable composition is in the uncured state (i.e., the second component is in the unpolymerized state), while diffusion of the second component contained in the photocurable composition is inhibited upon heat treatment of the toner after the photocurable composition is cured by irradiation of the coloring information providing light (i.e., after polymerization of the second component). Toner of this type will be occasionally referred to as "non-photocoloring toner" hereinafter.

The non-photocoloring toner contains, in the photocurable composition, at least the second component having a photopolymerizable group in the molecule. The photocurable composition used for the non-photocoloring toner may contain a photopolymerization initiator, and may contain as needed various other materials.

Because the second component itself in the non-photocoloring toner is photopolymerizable, the second component contained in the photocurable composition may easily diffuse even when light that provides coloring information is irradiated as long as the wavelength of the light is not in a particular wavelength region that allows curing of the photocurable composition; consequently, the first component in the microcapsule and the second component in the photocurable composition, when heat-treated in the state, react with each other (color-developing reaction), for example due to dissolution of the microcapsule shell.

In contrast, if light having a wavelength in a particular wavelength region that cures the photocurable composition is irradiated before heat treatment, the second component contained in the photocurable composition polymerizes, so that diffusion of the second component contained in the photocurable composition is inhibited. Thus, the second component, even if heat-treated, cannot come in contact with the first component in the microcapsule, so that the reaction between the first and second components (color-developing reaction) does not occur.

As described above, the coloration of the non-photocoloring toner can be controlled by controlling the reaction between the first and second components (color-developing reaction) through heat treatment with or without prior irradiation of light having a wavelength in a particular wavelength region capable of curing the photocurable composition which light provides coloring information.

Hereinafter, an exemplary structure of the F toner in which the photocurable composition above and microcapsules dispersed in the photocurable composition are contained will be described more in detail.

In this case, the toner may contain a photocurable composition and only one color-developing region containing microcapsules dispersed in the photocurable composition, but alternatively may contain two or more color-developing regions.

As described above, the term "color-developing region" above means a continuous region that can develop a particular color when an external stimulus is applied.

When the toner contains two or more color-developing regions, only one kind of color-developing region capable of developing the same color may be contained in a toner particle. In an exemplary embodiment, two or more color-developing regions developing different colors are contained in a single toner particle. The number of the colors developed by one toner particle is restricted to one in the former case, but is two or more in the latter case.

An example of the combination of the two or more color-developing regions capable of developing different colors from each other is a combination of a yellow color-developing region capable of developing yellow color, a magenta color-developing region capable of developing magenta color, and a cyan color-developing region capable of developing cyan color. In this case, for example, when only one kind of color-developing region develops color upon application of an external stimulus, the toner develops a color—one of yellow, magenta, or cyan; and, when two kinds of color-developing regions develop color, the toner can develop a color which is a combination of the colors of the two kinds of color-developing regions; therefore, one toner particle can assume various colors.

It is possible to control the color developed by the toner containing two or more color-developing regions developing colors different from each other, by making different the kinds and the combination of the first and second components contained in each kind of color-developing region and also by making different the wavelength of the light used for curing the photocurable composition contained in each kind of color-developing region.

Because the wavelength of the light needed for curing the photocurable composition contained in the color-developing region, in this case, varies depending on the kind of the color-developing region, multiple kinds of lights different in wavelength may be used that provides coloring information, each light corresponding to each kind of the color-developing region (specifically, to the photocurable composition in each color-developing region).

In order to make different the wavelength of the light needed for curing the photocurable composition contained in each color-developing region, a photopolymerization initiator sensitive to light having a different wavelength may be contained in the photocurable composition of each color-developing region.

For example, when the toner contains three kinds of color-developing regions developing colors in yellow, magenta, and cyan, and the photocurable compositions contained in the three kinds of color-developing regions cure to the highest degree under the same light amount at a wavelength of respectively 405 nm, 532 nm or 657 nm, the toner can develop a desired color by changing the wavelength of the irradiation light. The wavelength of the light irradiated to the toner may be selected from within the visible-ray range or the ultraviolet range.

Figure 7:
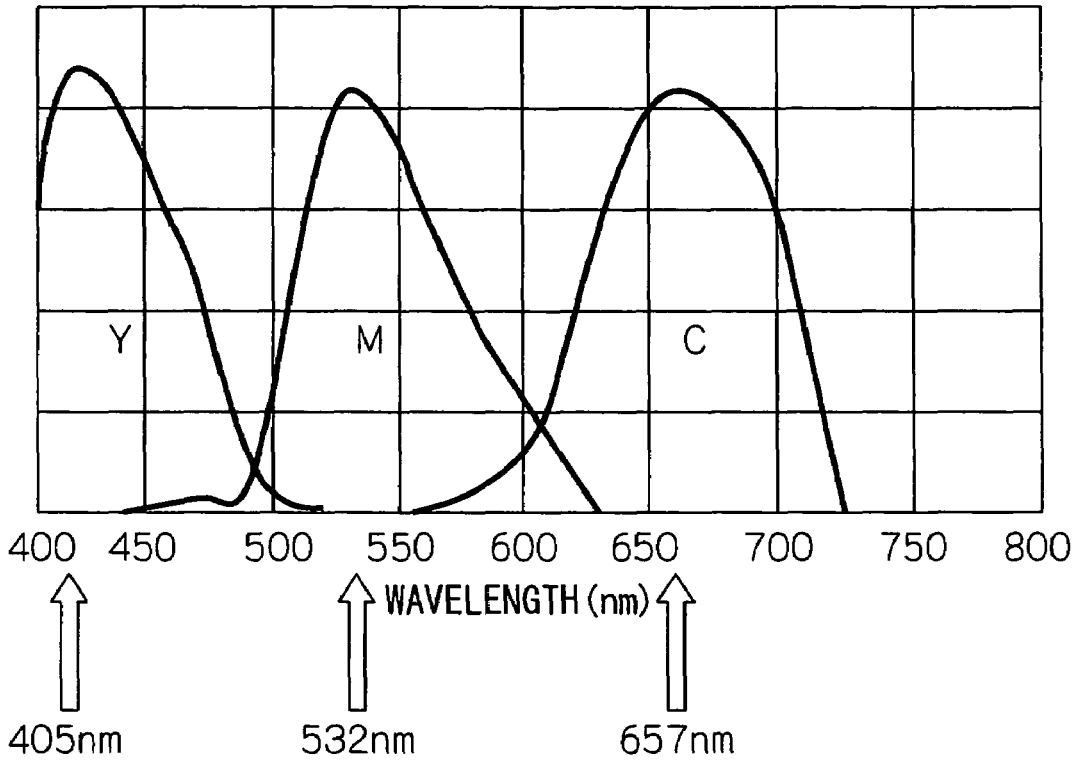
FIG. 7 is a schematic chart showing an example of the spectral sensitivity of toner.

Specifically, as shown in FIG. 7, when the toner contains three kinds of color-developing regions developing different colors from each other (Y, M, and G) (hereinafter, occasionally referred to as Y color-, M color-, and C color-developing regions), the Y color-developing region is sensitive, for example, to light having a wavelength of 400 to 530 nm and has the maximum spectral sensitivity at a wavelength of 405 nm.

The term "sensitivity" used herein refers to the degree of curing of the photocurable composition, i.e., the progress of the polymerization reaction of the developer monomer 54, with respect to the change in wavelength of the irradiation light upon irradiation of the color-developing region of toner with light at a predetermined light amount (hereinafter, referred to as standard light amount).

When light having a wavelength of 400 to 530 nm is irradiated at a certain light amount, the photocurable composition contained in the Y color-developing region starts curing and the polymerization reaction of the developer monomer 54 advances. When light at the wavelength corresponding to the maximum spectral sensitivity (405 nm) is irradiated, the photocurable composition cures to the highest degree and the polymerization reaction of the developer monomer 54 proceeds to the highest degree.

Similarly as shown in FIG. 7, the photocurable composition contained in the M color-developing region cures when irradiated with light having a wavelength of 500 to 630 nm, but the photocurable composition cures to the highest degree and the polymerization reaction of the developer monomer 54 proceeds to the highest degeee when light at the wavelength corresponding to the maximum spectral sensitivity (532 nm) is irradiated.

In addition, the photocurable composition contained in the C color-developing region cures when irradiated with light having a wavelength of 560 to 736 nm, but the photocurable composition cures to the highest degree and the polymerization reaction of the developer monomer 54 proceeds to the highest degree when light at the wavelength corresponding to the maximum spectral sensitivity (657 nm) is irradiated.

In the F toner for use in an aspect of the present invention, if the toner is irradiated at a constant light amount, the degree of the color-developing reactions caused by the first and second components in the same color-developing region is smaller when light at a wavelength that is closer to the wavelength corresponding to the maximum spectral sensitivity of the color-developing region is irradiated.

Alternatively, if the wavelength of the irradiated light is constant, the degree of the color-developing reaction is smaller when the amount of the light of providing coloring information is greater.

Because the toner develops color through the color-developing reaction between the first and second components, if the wavelength of the irradiated light is constant, the polymerization reaction of the developer monomer 54 progresses to a higher degree and the photocurable composition cures to a higher degree when the amount of the irradiated light is greater, and thus the color-developing reaction in the color-developing region corresponding to the wavelength of the irradiated light is more efficiently inhibited.

Figure 8:
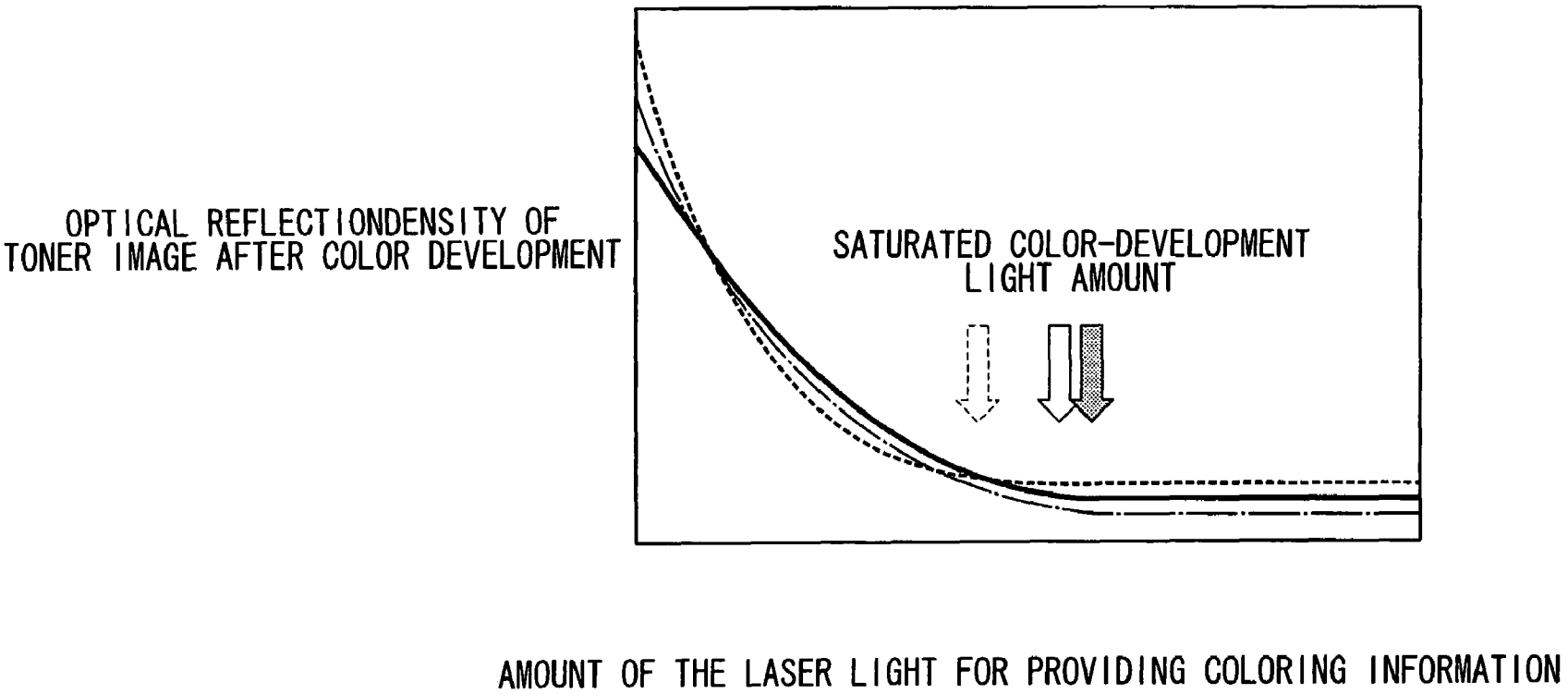
FIG. 8 is a schematic chart showing the relationship between the light exposure amount at the time of providing coloring information and the toner image density after color development.

Therefore as shown in FIG. 8, as the amount of the light irradiated for providing coloring information increases, the density of the toner after color development decreases. When the toner is irradiated at a predetermined light amount or more for providing coloring information, the toner is no longer able to develop the color determined depending on the wavelength of the irradiated light. The predetermined light amount will hereinafter be referred to as "saturated color-development light amount".

As described above, the photocurable composition contained in the color-developing region of the toner used in the image-forming apparatus according to an aspect of the present invention has a sensitivity that varies depending on the wavelength of the irradiated light. When light at a wavelength predetermined depending on the color not to be developed is irradiated, the toner retains its ability to develop color generated by the color-developing regions other than the color-developing region corresponding to the wavelength of the irradiated light, the color being at a density determined by the amount of the irradiated light.

The wavelength of the light irradiated to the F toner for providing coloring information is determined by the material design of the F toner used.

Specifically, the wavelength of the irradiation light is determined by the photocurable composition contained in each color-developing region of the F toner. When light at a wavelength determined by the spectral sensitivity characteristics of a photocurable composition contained in a color-developing region of the F toner is irradiated, the photocurable composition cures and the developer monomer 54 polymerizes in the color-developing region containing the photocurable composition among multiple color-developing regions, and the color-developing region is deprived of ability to develop the color determined depending on the wavelength of the irradiated light.

The toner for use in an aspect of the present invention may contain a base material containing, as a primary component, a binder resin similar to those used in conventional toners using a coloring agent such as pigment. In this case, each of the two or more color-developing regions may be dispersed as particulate capsules in the base material (hereinafter, a capsular color-developing region will be referred to as "photo- and thermo-sensitive capsule" in some cases). A releasing agent and various additives may also be contained in the base material, similarly to conventional toners containing a coloring agent such as pigment.

The photo- and thermo-sensitive capsules have a core region containing microcapsules and a photocurable composition and a shell encapsulating the core region. The shell is not particularly limited as long as the shell can enclose the microcapsules and the photocurable composition in the photo- and thermo-sensitive capsule stably without leakage to the exterior of the capsule during the toner production process described below or during storage of the toner. In an aspect of the present invention, the photo- and thermo-sensitive capsule may contain water-insoluble materials as the primary components, such as a releasing material and a binder resin consisting of a water-insoluble resin so as to prevent of leakage of the second component to the exterior matrix outside the photo- and thermo-sensitive capsule through the shell, or so as to prevent inflow of the second component originally contained in another photo- and thermo-sensitive capsule that can develop a different color through the shell during the toner production process described below.

Hereinafter, the toner components used in the F toner and the materials and the method used in adjusting the toner components will be described more in detail. In this case, the toner contains at least the first component, the second component, microcapsules containing the first component, and a photocurable composition containing the second component. The photocurable composition may contain a photopolymerization initiator, and may also contain various assistants and others. The first component may be present in the microcapsules (core region) in the solid state or in combination with a solvent.

In the non-photocoloring toner above, an electron-donating colorless dye or diazonium salt compound, for example, is used as the first component, and a photopolymerizable group-containing electron-accepting compound or photopolymerizable group-containing coupler compound, or the like may be used as the second component. In the photocoloring toner, an electron-donating colorless dye may be used as the first component; an electron-accepting compound (hereinafter, referred to as "electron-accepting developer" or "developer") may be used as the second component; and a polymerizable compound having an ethylenic unsaturated bond may be used as the photopolymerizable compound.

In addition to the materials listed above, various materials similar to the materials for conventional toners using a coloring agent, such as binder resin, a releasing agent, an internal additive, and an external additive, may be added as needed. Hereinafter, each material will be described more in detail.

—First and Second Components—

Examples of the combinations of the first and second components include the following combinations (a) to (r) (in the following examples, the former compound represents the first component and the latter compound represents the second component).

(a) Combination of an electron-donating colorless dye and an electron-accepting compound.

(b) Combination of a diazonium salt compound and a coupling component (hereinafter, occasionally referred to as "coupler compound").

(c) Combination of an organic acid metal salt such as silver behenate or silver stearate and a reducing agent such as protocatechin acid, spiroindane, or hydroquinone.

(d) Combination of a long-chain fatty acid iron salt such as ferric stearate or ferric myristate and a phenol compound such as tannic acid, gallic acid, or ammonium salicylate.

(e) Combination of i) an organic acid heavy metal salt such as nickel, cobalt, lead, copper, iron, mercury, or silver salt of acetic acid, stearic acid, palmitic acid, or the like and ii) an alkali metal or alkali-earth metal sulfide such as calcium sulfide, strontium sulfide, or potassium sulfide, or combination of i) such an organic acid heavy metal salt and ii) an organic chelating agent such as s-diphenyl carbazide or diphenyl carbazone.

(f) Combination of i) a heavy metal sulfate salt such as silver, lead, mercury, or sodium sulfate and ii) a sulfur compound such as sodium tetrathionate, sodium thiosulfate, or thiourea.

(g) Combination of an aliphatic ferric salt such as ferric stearate and an aromatic polyhydroxy compound such as 3,4-hydroxytetraphenyl methane.

(h) Combination of an organic acid metal salt such as silver oxalate or mercury oxalate and an organic polyhydroxy compound such as polyhydroxyalcohol, glycerin, or glycol.

(i) Combination of a fatty acid ferric salt such as ferric pelargonate or ferric laurate and a thiocesyl or isothiocesyl carbamide derivative.

(j) Combination of an organic acid lead salt such as lead caproate, lead pelargonate, or lead behenate and a thiourea derivative such as ethylenethiourea or N-dodecylthiourea.

(k) Combination of a higher fatty acid heavy metal salt such as ferric stearate or copper stearate and zinc dialkyldithiocarbamate.

(l) Combination forming an oxazine dye such as the combination of resorcin and a nitroso compound.

(m) Combination of a formazan compound and a reducing agent and/or a metal salt.

(n) Combination of a protected colorant (or leuco colorant) precursor and a deprotecting agent.

(o) Combination of an oxidative coloring agent and an oxidizing agent.

(p) Combination of a phthalonitrile compound and a diiminoisoindoline compound (combination producing by phthalocyanine).

(q) Combination of an isocyanate compound and a diiminoisoindoline compound (combination forming a coloring pigment).

(r) combination of a pigment precursor and an acid or base (combination forming a pigment).

Among the first components listed above, an electron-donating colorless dye, which is substantially colorless, or a diazonium salt compound is preferable.

Any one of known dyes may be used as the electron-donating colorless dye as long as the dye reacts with the second component to develop color. Specific examples thereof include phthalide compounds, fluorane compounds, phenothiazine compounds, indolylphthalide compounds, leucoauramine compounds, rhodamine lactam compounds, triphenylmethane compounds, triazene compounds, spiropyran compounds, pyridines, pyrazine compounds, fluorene compounds, and others.

In the case of the non-photocoloring toner, the second component is not particularly limited as long as the second component is a substantially colorless compound which has a photopolymerizable group and a moiety capable of reacting with the first component to develop color, and which has a function of reacting with the first component, such as an electron-accepting compound having a photopolymerizable group or a coupler compound having a photopolymerizable group, to develop color and a function of polymerizing and curing in reaction to light.

The electron-accepting compound having a photopolymerizable group, which is a compound having an electron-accepting group and a photopolymerizable group in the same molecule, is not particularly limited as long as i) the compound has a photopolymerizable group which causes photopolymerization and curing, and ii) the compound reacts with an electron-donating colorless dye as an example of the first component to develop color.

Hereinafter, the photopolymerization initiator will be described. When irradiated with light that provides coloring information, the photopolymerization initiator generates radicals, which initiate and accelerate the polymerization reaction in the photocurable composition. The photocurable composition cures through this polymerization reaction.

The photopolymerization initiator may be appropriately selected from known photopolymerization initiators, and may be a photopolymerization initiator containing a spectral sensitizing compound having the maximum absorption wavelength of 300 to 1000 nm and a compound interacting with the spectral sensitizing compound.

However, if the compound interacting with the spectral sensitizing compound used is a compound having both a colorant moiety having the maximum absorption wavelength of 300 to 1000 nm and a borate moiety in its structure, the spectral sensitizing colorant is not essential.

One compound or two or more compounds selected from known compounds that is capable of initiating a photopolymerization reaction with the photopolymerizable group in the second component may be used as the compound interacting with the spectral sensitizing compound.

When this compound is present in combination with the spectral sensitizing compound, the sensitivity may be improved and control of the radical generation may be achieved by using any light source in the ultraviolet to infrared region. This is because radicals are generate at high efficiency upon irradiation of light within the spectroscopic absorption wavelength region of the spectral sensitizing compound with high sensitivity.

The "compound interacting with a spectral sensitizing compound" is preferably an organic borate salt compound, a benzoin ether, a S-triazine derivative having a trihalogen-substituted methyl group, an organic peroxide or an azinium salt compound, more preferably an organic borate salt compound. It is possible to effectively generate radicals locally in the irradiated area and to improve the sensitivity, by combined use of the "compound interacting with a spectral sensitizing compound" with the spectral sensitizing compound.

A reducing agent such as an oxygen scavenger or an active hydrogen donor chain-transfer agent, and other compounds accelerating polymerization by chain transfer may be added to the photocurable composition in order to accelerate the polymerization reaction.

Examples of the oxygen scavenger include phosphines, phosphonates, phosphites, primary silver salts, and other compounds easily oxidized with oxygen. Specific examples thereof include N-phenylglycine, trimethylbarbituric acid, N,N-dimethyl-2,6-diisopropylaniline, and N,N,N-2,4,6-pentamethylanilineic acid. In addition, thiols, thioketones, trihalomethyl compounds, Rofn dimer compounds, iodonium salts, sulfonium salts, azinium salts, organic peroxide, azides and the like are also useful as the polymerization accelerators.

The first component such as an electron-donating colorless dye or a diazonium salt compound is encapsulated in microcapsules in the F toner.

Any known method may be used for the encapsulation. Examples thereof include the methods of using coacervation of a hydrophilic wall-forming material described in U.S. Pat. Nos. 2,800,457 and 28,000,458; the interfacial polymerization methods described in U.S. Pat. No. 3,287,154, British Patent No. 990443, Japanese Patent Publication (JP-B) Nos. 38-19574, 42-446, and 42-771, and others; the polymer precipitation methods described in U.S. Pat. Nos. 3,418,250 and 3,660,304; the method using an isocyanate polyol wall material described in U.S. Pat. No. 3,796,669; the method of using an isocyanate wall material described in U.S. Pat. No. 3,914,511; the methods of using a urea-formaldehyde or urea formaldehyde-resorcinol-based wall-forming material described in U.S. Pat. Nos. 4,001,140, 4,087,376, and 4,089,802; the method of using a wall-forming material such as a melamine-formaldehyde resin or hydroxypropylcellulose described in U.S. Pat. No. 4,025,455; the in-situ methods of monomer polymerization described in JP-B No. 36-9168 and JP-A No. 51-9079; the electrolytic dispersion cooling methods described in British Patent Nos. 952807 and 965074; the spray drying methods described in U.S. Pat. No. 3,111,407 and British Patent No. 930422; the methods described in JP-B No. 7-73069, and JP-A Nos. 4-101885 and 9-263057; and the like.

The material for use as the microcapsule wall is added to inside the oil droplet and/or outside the oil droplet. Examples of the materials for the microcapsule wall include polyurethane, polyurea, polyamide, polyester, polycarbonate, urea-formaldehyde resins, melamine resins, polystyrene, styrene-methacrylate copolymers, styrene-acrylate copolymers, and the like. Among them, polyurethane, polyurea, polyamide, polyester, and polycarbonate are preferable, and polyurethane and polyurea are more preferable. The polymer substances above may be used in combination of two or more.

The volume-average particle diameter of the microcapsules is preferably controlled in the range of 0.1 to 3.0 μm, more preferably in the range of 0.3 to 1.0 μm.

The photo- and thermo-sensitive capsule may contain a binder, and the same is true for the toner having one color-developing region.

Examples of the binders include binders similar to those used for emulsification or dispersion of the photocurable composition; the water-soluble polymers used for encapsulation of the first reactive substance; solvent soluble polymers such as polystyrene, polyvinylformal, polyvinylbutyral, acrylic resins such as polymethyl acrylate, polybutyl acrylate, polymethyl methacrylate, polybutyl methacrylate and the copolymers thereof, phenol resins, styrene-butadiene resins, ethylcellulose, epoxy resins, and urethane resin; or the latexes of these polymers may also be used. Among them, gelatin and polyvinyl alcohol are preferable. The binder resins described below are also usable as the binder.

The F toner may contain a binder resin used in conventional toners. In the toner having a structure containing photo- and thermo-sensitive capsules dispersed in a base material, the binder resin may be used, for example, as the primary component for the base material or the material for the shell of the photo- and thermo-sensitive capsule. However, use of the binder resin is not limited thereto.

The binder resin is not particularly limited, and any known crystalline or amorphous resin material may be used. In particular, a crystalline polyester resin showing a sharp melting property is useful for giving low-temperature fixability. Examples of the amorphous polymers (noncrystalline resins) include known resin materials such as styrene acrylic resin and polyester resin, and noncrystalline polyester resins are particularly preferable.

In addition, the F toner may contain components other than those listed above. The other components are not particularly limited and can be selected appropriately according to applications, and examples thereof include various known additives used in conventional toners such as releasing agents, inorganic fine particles, organic fine particles, and antistatic agents.

The first and second components in the F toner according to an aspect of the present invention may be colored before color development, but are preferably substantially colorless.

Hereinafter, the method of producing the F toner will be described briefly.

The F toner may be prepared by a known wet production method such as aggregation coalescence method. The wet production method may be used for preparation of a toner having a structure containing first and second components that develop color in reaction therebetween, a photocurable composition, and microcapsules dispersed in the photocurable composition wherein the first component is contained in the microcapsules and the second component is contained in the photocurable composition.

The microcapsules used in the toner having such a structure may be a heat-responsive microcapsules, but may alternatively be microcapsules sensitive to other stimuli such as light.

Any one of known wet production methods may be used for production of the toner. Among the wet production methods, use of the aggregation coalescence method is preferable because it may reduce the maximum processing temperature and may produce toners having various structures easily.

When compared with conventional toners containing a pigment and a binder resin as primary components, the particles of the toner having such a structure, which includes a large amount of photocurable compositions containing low-molecular weight components as primary components, often have insufficient strength after granulation of the toner; use of the aggregation coalescence method is advantageous also from this point because the aggregation coalescence method does not involve application of high shearing force.

In general, the aggregation coalescence method includes preparing dispersion liquids of various materials for the toner, forming aggregate particles in a raw material dispersion liquid obtained by mixing two or more dispersion liquids, and coalescing the aggregate particles formed in the raw material dispersion liquid, and additionally as needed, forming a coating layer by depositing components for forming a coating layer on the surface of the aggregate particles between the forming of the aggregate particles and coalescing of the aggregate particles. Although the kinds and combination of various dispersion liquids used as raw materials may be different in production of the F toner, the toner may be prepared through an appropriate combination of the forming of the aggregate particles and coalescing of the aggregate particles, and, optionally, forming of a coating layer.

For example, in the case of a toner having a structure containing photo- and thermo-sensitive capsules dispersed in a resin, one or more photo- and thermo-sensitive capsule dispersion liquids capable of developing different colors from each other are prepared through a first aggregation process (a1) of forming first aggregate particles in a raw material dispersion liquid including i) a microcapsule dispersion liquid containing dispersed microcapsules containing the first component and ii) a photocurable composition dispersion liquid containing dispersed photocurable composition containing the second component, a deposition process (b1) of adding a first resin particle dispersion liquid containing dispersed resin particles to the raw material dispersion liquid containing the first aggregate particles formed to deposit the resin particles on the surface of the aggregate particles, and a first coalescing process (c1) of preparing first coalescence particles (photo- and thermo-sensitive capsules) by heating the raw material dispersion liquid containing the aggregate particles having the resin particles deposited on the surface to cause coalescence.

A toner having a structure in which photo- and thermo-sensitive capsules are dispersed is then prepared through a second aggregation process (d1) of forming second aggregate particles in a mixed solution of the one or more photo- and thermo-sensitive capsule dispersion liquids and a second resin particle dispersion liquid containing dispersed resin particles and a second coalescing process (e1) of producing second coalescence particles by heating the mixed solution containing the second aggregate particles.

In an exemplary embodiment, two or more kinds of the photo- and thermo-sensitive capsule dispersion liquids are used in the second aggregation process. The photo- and thermo-sensitive capsules obtained through processes (a1) to (c1) may be used as a toner (i.e., toner containing only one color-developing region) as it is.

An exemplary method for producing a toner containing only one color-developing region may include, in place of the above deposition process, a first deposition process of adding a releasing agent dispersion liquid containing a dispersed releasing agent to a raw material dispersion liquid containing the first aggregate particles to deposi the releasing agent on the aggregate particle surface, and a second deposition process of depositing resin particles on the surface of the aggregate particles having the releasing agent deposited on their surfaces by adding a first resin particle dispersion liquid containing dispersed resin particles to the raw material dispersion liquid after the first deposition process.

The volume-average particle diameter of the F toner for use in an aspect of the present invention is not particularly limited, and may be appropriately adjusted according to the structure of toner and the kinds and the number of the color-developing regions contained in the toner. However, when 2 to 4 kinds of color-developing regions capable of developing different colors from each other (for example, three kinds of color-developing regions capable of developing colors in yellow, cyan, and magenta, respectively) are contained in the toner, the volume-average particle diameter is preferably in the range below, depending on each toner structure.

For example, when the toner has a structure in which photo- and thermo-sensitive capsules (color-developing regions) are dispersed in a resin, the volume-average particle diameter of the toner is preferably in the range of 5 to 40 μm and more preferably in the range of 10 to 20 μm. The volume-average particle diameter of the photo- and thermo-sensitive capsules contained in the toner having such a particle diameter is preferably in the range of 1 to 5 μm and more preferably in the range of 1 to 3 μm.

When the volume-average particle diameter of the toner is less than 5 μm, there may be cases where color reproducibility and image density is worsened due to decrease in the amount of coloring components in the toner. When the volume-average particle diameter of the toner is more than 40 μm, there may be cases where uneven glossiness of image surface is observed due to increase in image surface irregularity, and/or the image quality is deteriorated.

The toner in which multiple photo- and thermo-sensitive capsules are dispersed tends to have a particle diameter larger than that of the conventional small-diameter toners (whose volume-average particle diameter is approximately 5 to 10 μm) using a coloring agent. Even so, the toner containing the dispersed multiple photo- and thermo-sensitive capsules gives an image higher in definition because the image definition is determined not by the particle diameter of toner but by the particle diameter of the photo- and thermo-sensitive capsules. In addition, the toner is superior in powder flowability and thus, sufficient flowable is ensured even when the amount of external additives is small, and developability and cleaning efficiency may also be improved.

On the other hand, the particle diameter of a toner having only one color-developing region may be reduced more easily than the toner described above, and the volume-average particle diameter is preferably in the range of 3 to 8 μm and more preferably in the range of 4 to 7 μm. An excessively smaller volume-average particle diameter of less than 3 μm may lead to insufficient powder flowability or insufficient durability. Alternatively, a volume-average particle diameter of more than 8 μm may hinder formation of a high-definition image.

Toners, including the F toner described above, may be used in an aspect of the present invention regardless of the constituent materials, the structure of toner, coloring mechanism, and others, as long as the toner can be controlled to maintain the coloring or non-coloring state by irradiation of light (or non-irradiation of light).

The toner for use in an aspect of the present invention preferably has a volume-average particle distribution index GSDv of 1.30 or less and a ratio of the volume-average particle distribution index GSDv to a number-average particle diameter distribution index GSDp (GSDv/GSDp) of 0.95 or more.

More preferably, the volume-average particle distribution index GSDv is 1.25 or less, and the ratio of the volume-average particle distribution index GSDv to the number-average particle diameter distribution index GSDp (GSDv/GSDp) is still more preferably 0.97 or more.

A volume distribution index GSDv of more than 1.30 sometimes leads to decrease in image resolution, while a ratio of volume-average particle distribution index GSDv to number-average particle diameter distribution index GSDp (GSDv/GSDp) of less than 0.95 sometimes leads to deterioration in the electrostatic properties of toner and also to image defects caused, for example, by scattering of toner or fogging.

In an aspect of the present invention, the volume-average particle diameter, the volume-average particle distribution index GSDv, and the number-average particle diameter distribution index GSDp of the toner are determined as follows. A cumulative volume distribution curve and a cumulative number distribution curve are drawn from the side of the smaller particle size, respectively, for each particle size range (channel) as a result of division of the particle size distribution measured by using a measuring instrument, for example, a Coulter Multisizer II (manufactured by Beckmann Coulter) or the like, and the particle diameter providing 16% cumulative is defined as volume $D_{16v}$ and number $D_{16p}$; that providing 50% cumulative being defined as volume $D_{50v}$ and number $D_{50p}$; and that providing 84% cumulative being defined as volume $D_{84v}$ and number $D_{84p}$. Using these values, the volume-average particle size distribution index GSDv is calculated as $(D_{84v}/D_{16v})^{1/2}$, and the number-average particle size distribution index GSDp is calculated as $(D_{84p}/D_{16p})^{1/2}$. The volume average particle size distribution index (GSDv) and the number-average particle size distribution index (GSDP) can be calculated with the formulae above.

Alternatively, the volume-average particle diameter of the microcapsules and the photo- and thermo-sensitive capsules may be determined, for example by using a laser-diffraction particle size distribution analyzer (LA-700, manufactured by Horiba, Ltd.).

The toner according to an aspect of the present invention may have a shape factor SF1 represented by the following Formula (1) in the range of 110 to 130.

$$SF1=(ML^2/A)\times(\pi/4)\times 100 \quad \text{Formula (1)}$$

(in Formula (1), ML represents the maximum length (μm) of toner; and A represents the projection area ($\mu m^2$) of toner).

A toner having a shape factor SF1 of less than 110 tends to remain on the image carrier at the transferring process in the image formation, in which case removal of the residual toner is necessary, and the cleanability at cleaning of the residual toner with a blade is easily deteriorated, whereby image defects are generated depending on cases.

On the other hand, a toner having a shape factor SF1 of more than 130 is, when used as a developer, occasionally broken by collision with the carrier in the developing device, which in turn leads to deterioration in electrostatic properties by increase in the amount of fine powder and contamination of the image carrier with the releasing agent component exposed on the toner surface, and also to problems caused by the fine powder such as increase in the fogging.

The shape factor SF1 can be determined as follows. First, the optical microscope image of the toner particles scattered on a slide glass was taken into a Luzex image-analyzer (FT, manufactured by Nireco Corporation) through a video camera, and for 50 or more toner particles, the maximum length (ML) and the projected area (A) were measured. Then, the square of the maximum length and projection area are calculated for each toner, and the shape factor SF1 is determined according to the formula (1) above The toner for use in an aspect of the present invention may be used as it is as a mono-component developer, or may be used as a toner for two-component developer consisting of a carrier and the toner.

For forming a color image with one kind of developer, the developer may be (1) a developer having a toner containing two or more kinds of color-developing regions containing a photocurable composition and microcapsules dispersed in the photocurable composition wherein the two or more kinds of color-developing regions contained in the toner develop different colors from each other, or, (2) a developer containing two or more toners each containing a color-developing region containing a photocurable composition and microcapsules dispersed in the photocurable composition, the toners being mixed with each other and the color-developing regions of the two or more toner being capable of developing different colors from each other.

For example, in the case of the developer if the former type, the toner may contain three kinds of color-developing regions—a yellow color-developing region capable of developing yellow color, a magenta color-developing region capable of developing magenta color, and a cyan color-developing region capable of developing cyan color. The developer of the latter type may contain a yellow color-developing toner whose color-developing region can develop yellow color, a magenta color-developing toner whose color-developing region can develop magenta color, and a cyan color-developing toner whose color-developing region can develop cyan color, the toners being mixed with each other.

The carrier for use in the two-component developer may have a core material whose surface is coated with a resin. The core material of the carrier is not particularly limited as long as it satisfies the above-mentioned condition. Examples thereof include magnetic metals such as iron, steel, nickel, and cobalt; alloys thereof with manganese, chromium, a rare-earth metal, or the like; and magnetic oxides such as ferrite and magnetite. Ferrite is preferable from the viewpoint of core material surface property and core material resistance; and the alloys thereof with manganese, lithium, strontium, magnesium, or the like are more preferable.

The resin for coating the core material surface is not particularly limited if it can be used as a matrix resin, and may be selected appropriately in accordance with the purpose.

The blending ratio of the toner according to an aspect of the present invention to the carrier, toner: carrier (by weight), in the two-component developer is preferably in the range of approximately 1:100 to 30:100 and more preferably in the range of approximately 3:100 to 20:100.

Hereinafter, the image-forming apparatus according to an aspect of the present invention will be described.

The image-forming apparatus according to an aspect of the present invention forms a color image electrophotographically using the F toner.

The image-forming process in the image-forming apparatus according to an aspect of the present invention is not particularly limited, and may be a so-called electrophotographic process, a process (ionography) of forming an electrostatic latent image on a dielectric material, for example, with ions, a process of forming an electrostatic latent image on a uniformly charged dielectric material by the heat of thermal head according to image information, or a process not using an electrostatic latent image, such as a process of forming a toner image through forming a magnetic latent image or a process of forming a toner image through ejecting of tacky ink droplets on an image carrier according to image information.

As shown in FIG. 1, the image-forming apparatus 10 according to an aspect of the present invention has a photoreceptor (image carrier) 11 commonly used in the electrophotographic process. The photoreceptor 11 rotates in a predetermined direction (direction indicated by arrow A in FIG. 1). There are installed, in the neighborhood of the outer circumferential surface of the photoreceptor 11 along the rotation direction of the photoreceptor 11, a charging device 12 that charges the surface of the photoreceptor 11, an exposure device (light-exposure unit) 14 that forms an electrostatic latent image corresponding to image data on the surface of the charged photoreceptor 11, a developing device (developing unit) 16 that develops the electrostatic latent image with the F toner, a coloring information providing device 28 that provides coloring information to the toner image by irradiating the surface of the photoreceptor 11, and a transfer device (transfer unit) 18 that transfers the toner image formed on the photoreceptor 11 onto a recording medium 26.

In the present embodiment, the coloring information providing device 28 is installed in the neighborhood of the outer circumferential surface of the photoreceptor 11. However, the coloring information providing device 28 may be installed at the inner circumferential side of the photoreceptor 11.

Figure 2:
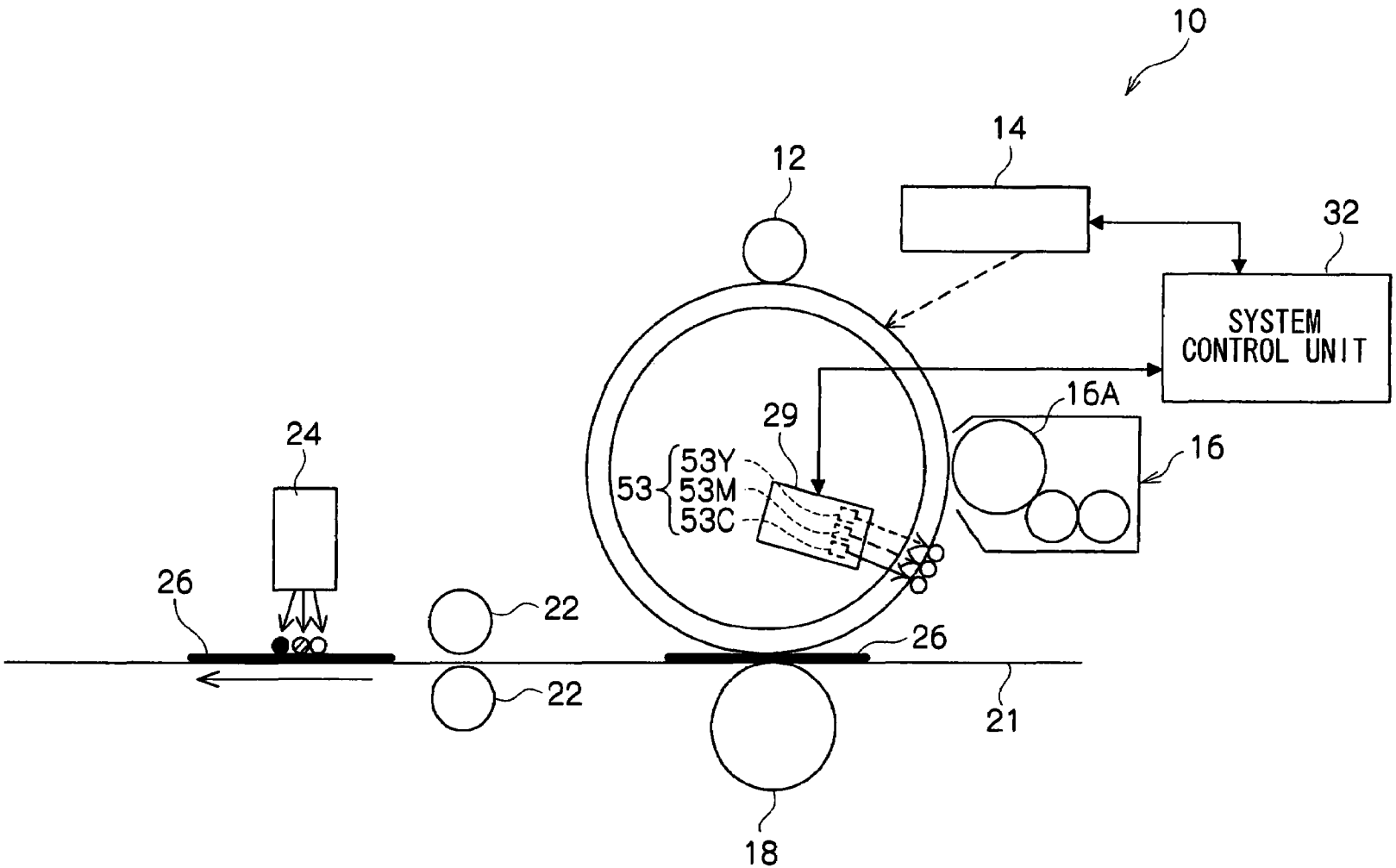
FIG. 2 is a schematic view illustrating an example of the configuration of an image-forming apparatus according to an aspect of the present invention, this configuration being different from that shown in FIG. 1.

In this case, the coloring information providing device 28 may be configured to scan-irradiate the light in the direction from the inner circumferential surface side of the photoreceptor 11 toward the outer circumferential surface of the photoreceptor 11 (corresponding to the coloring information providing device 29 shown in FIG. 2). In this case, as described above, the photoreceptor 11 may be transparent. The configuration of the coloring information providing device 29 may be the same as that of the coloring information providing device 28. The other reference characters in FIG. 2 represent the same members as in FIG. 1.

Any one of known photoreceptors may be used as the photoreceptor 11. For example, the photoreceptor may have a conductive base material and an inorganic photosensitive layer (made of, for example, Se or a-Si) or single- or multi-layered organic photosensitive layer provided on the conductive base material. In the case of a belt-shaped photoreceptor, a transparent resin such as PET or PC may be used as the base material, and the thickness of the base material may be determined in consideration of the design specifications such as the diameter or tension of the rolls stretching the belt-shaped photoreceptor, and is in the range of approximately 10 to 500 μm. The other details such as layer structure are the same as in the case of a drum-shaped photoreceptor.

When the photoreceptor 11 is irradiated with the light emitted from the coloring information providing device 28 and the light reaches the photoreceptor 11 from the inner circumferential side of the photoreceptor 11, a transparent photoreceptor containing a base material made of, for example, a transparent resin may be used.

If the photoreceptor 11 is transparent, the base material of the photoreceptor 11 is a material transparent to the irradiation light. For example, glass or a plastic material is used as the base material, and an electrically conductive layer is formed on the outer surface of the base material for formation of an electrode or the base material itself is processed to acquire electrical conductivity. If a transparent photoreceptor is not used, a base material commonly used such as a metal cylinder (e.g., an aluminum cylinder) or a nickel seamless belt is also usable, in addition to the transparent base materials described above.

The term "transparent" used herein means that the transmittance of outgoing light with respect to incident light (outgoing light/incident light) is 50% or more in the use wavelength region.

The transparent photoreceptor 11 has a transparent material such as a glass or plastic as the base material and a photosensitive layer and others provided on the surface of the base material. The thickness of the base material is determined according to the required mechanical strength, and is preferably in the range of approximately 0.1 to 5 mm. It is preferable to provide a transparent electrode on the transparent base material. The transparent electrode may be formed by coating with a mixture of an atomized metal oxide such as of ITO or $SnO_2$ and a binder resin, or with a conductive polymer such as polypyrrole. The thickness of the transparent electrode is determined from the required conductivity and permeability, and is preferably in the range of approximately 0.01 to 10 μm.

Examples of the photosensitive layer include inorganic photosensitive layers of Se and a-Si and single- or multi-layered organic photosensitive layers (charge-generating layer, charge-transport layer, etc.). In order to facilitate the scattering of the incident light, particles (e.g., particles of metal oxides, organic particles such as particles of fluororesins) having a particle diameter of dozens of nanometers to several microns may be dispersed in the photosensitive layer.

However, as described above, the photosensitive layer is preferably higher in light transmission because the light should pass through the layer to reach the toner. As for the degree of the light transmittance, the transmittance of the photosensitive layer itself is preferably 50% or more, more preferably 70% or more.

The light irradiation for providing coloring information is performed at an intensity significantly higher than that for forming a normal latent image. Specifically, the amount of the light energy for providing coloring information is approximately 1,000 times higher than the light amount (2 $mJ/m^2$) on the photoreceptor used in the normal electrophotographic process. There is thus a concern about the damage on the photoreceptor 11 caused by providing coloring information, but it is possible to prevent such a problem, for example, by reducing the light sensitivity of the charge-generating layer of photoreceptor 11 to 1/1000 of that of conventional devices.

The thickness of the photosensitive layer is determined by the transmittance described above and insulating performance sufficient for ensuring insulation against the electrostatic potential taking the decrease in film thickness over time into consideration. The thickness of the photosensitive layer may be in the range of approximately 5 to 50 μm.

In the case of a belt-shaped photoreceptor, a transparent resin such as PET or PC may be used as the transparent base material, and the thickness thereof may be decided in consideration of the design factors such as the diameter of the rolls stretching the belt-shaped photoreceptor and the tension of the belt-shaped photoreceptor. The thickness may be in the range of approximately 10 to 500 μm. The other details such as layer structure are the same as in the case of a drum-shaped photoreceptor.

On the other hand, when a toner image is formed by ionography, a dielectric material is used in place of the photoreceptor 11. The dielectric material is preferably transparent for the same reasons as described above. Examples of transparent dielectric materials for use include those obtained by replacing the photosensitive layer of the transparent photoreceptor described above with a transparent dielectric layer, for example, of a transparent plastic material such as PET or PC.

The charging device 12 charges the outer circumferential surface of the photoreceptor 11 to a predetermined electric potential.

Any one of known charging devices may be used as the charging device 12 for charging the photoreceptor 11. In a contact system, roll, brush, magnetic brush, blade, or the like may be used, and in a non-contact system, Corotron, Scorotron, or the like may be used. However, the charging device 12 is not limited thereto.

Among them, a contact charger is used favorably in view of the balance between charging compensation capacity and the amount of generated ozone. A contact system charges the surface of the photoreceptor 11 by applying a voltage to a conductive member in contact with the surface of the photoreceptor 11. In this case, the charging device 12 has a conductive member and a voltage-applying unit for applying a voltage to the conductive member (not shown in Figure).

The shape of the conductive member is not limited, and may be brush, blade, pin electrode, or roll shaped, but a roll-shaped member is preferable. Usually, a roll-shaped member has, from outside, a resistance layer, an elastic layer supporting the same, and a core material. The member may have, as needed, a protective layer outside the resistance layer.

During charging of the photoreceptor 11 by using the conductive member, a voltage is applied to the conductive member, and the applied voltage may be a DC voltage or a DC voltage superposed with an AC voltage.

When charging is performed only with direct current, the absolute value of the voltage is preferably (the desired surface electric potential+approximately 500 V), specifically in the range of 700 to 1,500 V. When AC voltage is superposed, the direct current may be within about ±50 V from the desired surface electric potential, the interpeak voltage of the alternate current (Vpp) is preferably 400 to 1,800 V, more preferably 800 to 1,600 V; the frequency of the AC voltage is 50 to 20,000 Hz, preferably 100 to 5,000 Hz; and the waveform of the AC voltage may be any one of a sine wave, a rectangular wave, or a triangular wave.

The charging potential is preferably adjusted in the range of 150 to 700 V in terms of the absolute value of the electric potential.

In the image-forming apparatus 10, the exposure device 14 irradiates the surface of the photoreceptor 11 with light modulated based on the image data of the image to be recorded, so as to form an electrostatic latent image corresponding to the image data on the surface of the photoreceptor 11 which has been charged by the charging device 12.

Any one of known exposure devices may be used as the exposure device 14 for forming an electrostatic latent image on the photoreceptor 11, and examples thereof include a laser scanning system, a LED image bar system, an analog light-exposure unit, an ion-current control head, and the like. In addition, new light-exposure unit to be developed in the future may also be used as long as the advantageous effects of aspects of the present invention are obtained.

The wavelength of the light irradiated from the exposure device 14 to the photoreceptor 11 may be in the spectral sensitivity region of the photoreceptor 11. Semiconductor lasers hitherto available are mainly near-infrared lasers having an oscillation wavelength around 780 nm, but lasers having an oscillation wavelength in the range of 600 to 700 nm and blue lasers having an oscillation wavelength close to 400 to 450 nm are recently available. In addition, a surface emission laser source allowing multibeam output is also effective for forming a color image. Alternatively, an LED (Light Emitting Diode) may be used instead.

Irradiation on the photoreceptor 11 is performed at the toner-developing position described below in the case of reversed development and to the position other than the toner-developing position in the case of normal development, for example, at a light amount of the logical sum of pieces of image-forming information for three colors (Y, M, and C).

The irradiation-spot diameter is preferably in the range of 40 to 80 μm in order to control the definition at 600 to 1,200 dpi. As for the exposure amount, the electric potential in the exposed region on the photoreceptor 11 (hereinafter, referred to as post-exposure electric potential for convenience) may be in the range of about 5 to 30% of the charging potential described above. Because the developing toner amount is altered according to the image density in the present embodiment, the exposure amount is varied according to the density (gradation value) at each exposure position.

On the other hand, in the case of the ionography, a latent image is formed on the image carrier with an ionic writing head. Examples of the ionic writing heads include those controlling on/off of the ion current according to image signal (JP-A No. 4-122654), those controlling on/off of the ion current generation (JP-A No. 6-99610), and the like. A dielectric material as well as a photoreceptor may be used as the image carrier in such a system.

The developing device 16 forms a toner image corresponding to the electrostatic latent image on the photoreceptor 11 by developing the electrostatic latent image formed on the outer circumferential surface of photoreceptor 11 with a toner.

The developing device 16 stores the F toner. The developing device 16 has a development roll 16A carrying the toner stored in the developing device 16 and supplying the toner to the surface of the photoreceptor 11.

Any one of known developing devices may be used as the developing device 16. The developing method may be any developing method, examples of which include a two-component developing method using a toner and microparticles called carrier that holds the toner, a mono-component developing method of using only toner, and developing methods which is modifications of the above methods and which involves use of other additives for improving development and other characteristics.

A developing method in which the developer contacts the photoreceptor 11, a developing method in which the developer does not contact the photoreceptor 11, or a combination thereof may be used. In addition, a hybrid developing method, which is a combination of a mono-component developing method and a two-component developing method may also be used. Further, new developing methods to be developed in the future may also be used as long as the advantageous effects of aspects of the present invention are obtained.

The toner contained in the developer may contain, for example, a color-developing region capable of developing Y color (Y color-developing region), a color-developing region capable of developing M color (M color-developing region) and a color-developing region capable of developing C color (C color-developing region) in a single toner particle. As an alternative, the Y color-developing region, the M color-developing region, or the C color-developing region may be contained separately in different toner particles.

The developing toner amount (amount of the toner deposited on the photoreceptor) may vary depending on the image to be formed, but is preferably in the range of 3.5 to 8.0 g/m$^2$, more preferably in the range of 4.0 to 6.0 g/m$^2$ in the case of a solid image.

The thickness of the toner layer in the obtained toner image T may be not more than a certain value such that the light for providing coloring information described below reaches the entire irradiated region. Specifically, for example, the number of the toner layers of a solid image is preferably 3 or less, more preferably 2 or less. The toner layer thickness above is a value obtained by measuring the thickness of the toner layer actually formed on the surface of the photoreceptor 11 and dividing the thickness by the number-average particle diameter of toner.

The coloring information providing device 28 has a light source 53 that emits light having a predetermined wavelength determined depending on the color not to be developed based on the color component information in image data. The light source 53 irradiates the toners constituting the toner image formed on the photoreceptor 11 with the light, thereby providing the toners with the coloring information.

The coloring information providing device 28 in FIG. 1 is installed between a developing device 16 and a transfer device 18 disposed at downstream side of the developing device 16 with respect to the rotation direction of the photoreceptor 11. However, the coloring information providing device 28 may be disposed at the downstream side of the transfer device 18 with respect to the transportation direction of the recording medium 26.

With the coloring information providing device 28, the photoreceptor 11 is scan-irradiated with light from the outer circumferential surface side of photoreceptor 11, the scanning being conducted in the direction along the rotating axis of the photoreceptor 11.

In FIGS. 1 and 2, 53Y, 53M, and 53C represent respectively a Y-color irradiating subunit, a M-color irradiating subunit, and C-color irradiating subunit. 32 represents a system control unit.

Figure 3:
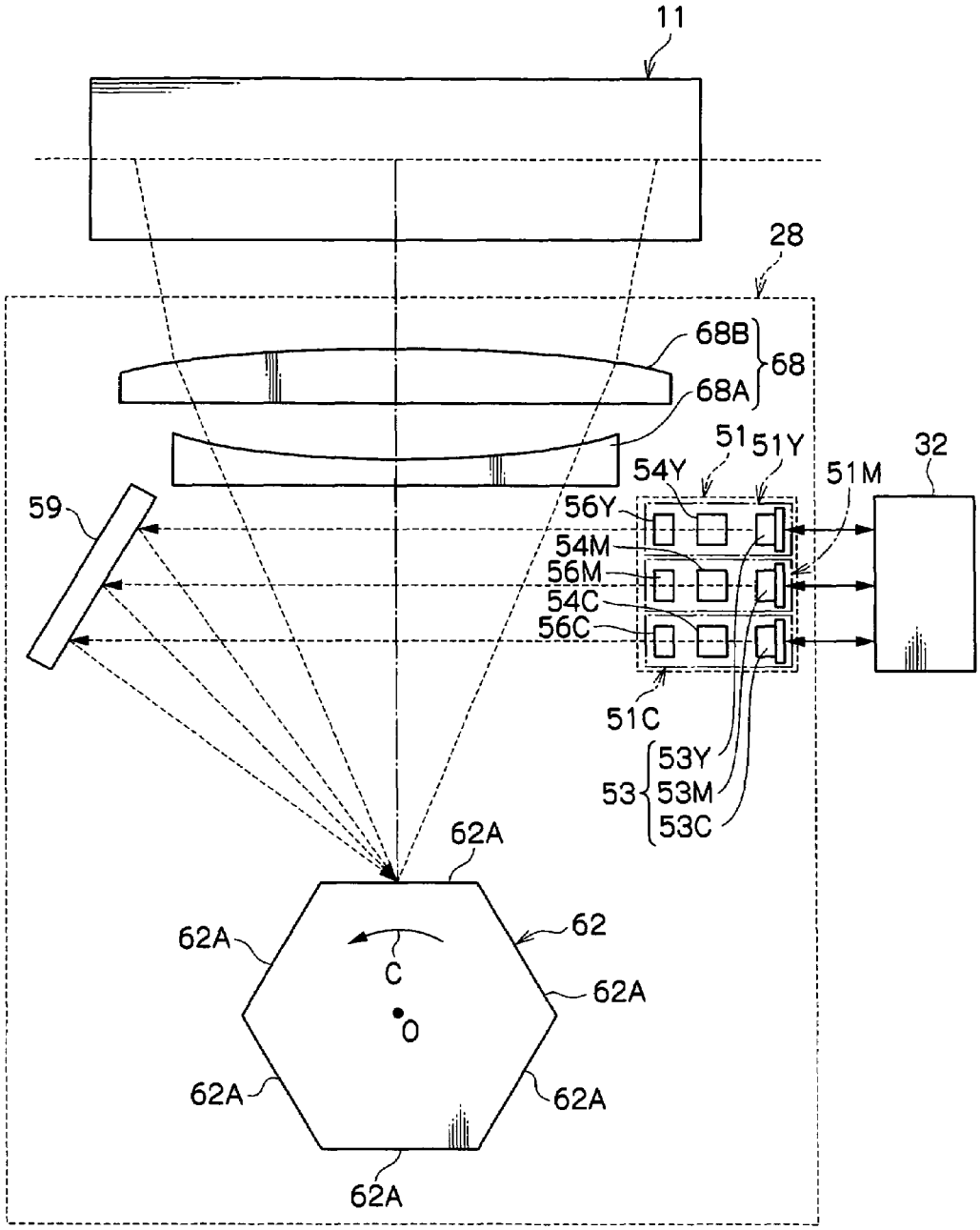
FIG. 3 is a schematic view illustrating an example of the configuration of a coloring information providing device in an image-forming apparatus according to an aspect of the present invention.

As shown in FIG. 3, the coloring information providing device 28 (and coloring information providing device 29) has a photoirradiation unit 51 containing a light source 53 emitting light at particular wavelengths, a reflection mirror 59 that reflects the lights emitted from the light source 53, a rotating polygon mirror 62 which reflects the lights that have been reflected by the reflection mirror 59 and which irradiates the photoreceptor 11 with the reflected lights, and a fθ lens 68.

The photoirradiation unit 51 has photoirradiation subunits, the number of which corresponds to the kinds of the color-developing regions contained in the toner stored in the developing device 16. In the present embodiment, a case where there are three kinds of color-developing regions corresponding to Y, M, and C colors will be described. Thus, the photoirradiation unit 51 will be described as having three irradiation subunits—a Y-color irradiating subunit 51Y corresponding to the Y color-developing region, a M-color irradiating subunit 51M corresponding to the M color-developing region, and a C-color irradiating subunit 51C corresponding to the C color-developing region. However, the configuration is not limited thereto.

The Y-color irradiating subunit 51Y has a light source 53Y. The light source 53Y emits light based on the color component information in image data, the light having a wavelength determined in advance for the Y color, which is a color whose development is inhibited by the exposure to the light. The wavelength of the light emitted from the light source 53Y is set, in advance, to the wavelength corresponding to the maximum spectral sensitivity of the Y color-developing region, i.e., the wavelength inhibiting progress of the color-developing reaction in the Y color color-developing region most effectively when irradiated at the standard exposure amount. In addition, Y-color irradiating subunit 51Y has a collimator lens 54Y and a cylinder lens 56Y in that order along the direction of the light emitted from the light source 53Y. Power supply to the light source 53Y is controlled to ON/OFF state by the system control unit 32 according to the color component information in image data, and a modulated light is emitted based on the image data. The light emitted from the light source 53Y is substantially collimated by a collimator lens 54Y, converged by a cylinder lens 56Y, and then guided by a reflection mirror 59 onto a rotating polygon mirror 62.

Similarly, the M-color irradiating subunit 51M has a light source 53M. The light source 53M emits light based on the color component information in image data, the light having a wavelength determined in advance for the M color, which is a color whose development is inhibited by the exposure to the light. The wavelength of the light emitted from the light source 53M is set, in advance, to the wavelength corresponding to the maximum spectral sensitivity of the M color-developing region, i.e., the wavelength inhibiting progress of the color-developing reaction in the M color color-developing region most effectively when irradiated at the standard exposure amount.

In addition, M-color irradiating subunit 51M has a collimator lens 54M and a cylinder lens 56M in that order along the direction of the light emitted from the light source 53M. Power supply to the light source 53M is controlled to ON/OFF state by the system control unit 32 according to the color component information in image data, and a modulated light is emitted based on the image data. The wavelength of the light emitted from the light source 53M is set, in advance, to the wavelength corresponding to the maximum spectral sensitivity of the M color-developing region, i.e., the wavelength inhibiting progress of the color-developing reaction in the M color color-developing region most effectively when irradiated at the standard exposure amount.

The light emitted from the light source 53M is substantially collimated by a collimator lens 54M, converged by a cylinder lens 56M, and then guided by a reflection mirror 59 onto a rotating polygon mirror 62.

Similarly, the C-color irradiating subunit 51C has a light source 53C. The light source 53C emits light based on the color component information in image data, the light having a wavelength determined in advance for the C color, which is a color whose development is inhibited by the exposure to the light. The wavelength of the light emitted from the light source 53C is set, in advance, to the wavelength corresponding to the maximum spectral sensitivity of the C color-developing region, i.e., the wavelength inhibiting progress of the color-developing reaction in the C color color-developing region most effectively when irradiated at the standard exposure amount.

In addition, C-color irradiating subunit 51C has a collimator lens 54C and a cylinder lens 56C in that order along the direction of the light emitted from the light source 53C. Power supply to the light source 53C is controlled to ON/OFF state by the system control unit 32 according to the color component information in image data, and a modulated light is emitted based on the image data. The light emitted from the light source 53C is substantially collimated by a collimator lens 54C, converged by a cylinder lens 56C, and then guided by a reflection mirror 59 onto a rotating polygon mirror 62.

In the description below, the light sources 53Y, 53 M, and 53C will be called collectively light source 53.

The rotating polygon mirror 62 is regular polygonal (regular hexagonal shape in the present embodiment) in shape and has multiple reflective planes 62A provided on the sidewall. The rotating polygon mirror 62 rotates around its rotating axis O as a rotation center in the direction indicated by arrow C at a predetermined speed, the rotation being driven by a motor not shown in the Figure.

The light entering onto the rotating polygon mirror 62 is converged onto the reflection plane 62A of rotating polygon mirror 62, and the incident angle of the light on each reflection plane 62A changes continuously by rotation of the rotating polygon mirror 62. In this way, the photoreceptor 11 is scan-exposed with the light beam along the direction of the axis of the photoreceptor 11.

In the traveling direction of the reflected light from the rotating polygon mirror 62, there is installed a fθ lens 68*a* consisting of a first lens 68A and a second lens 68B as a scanning lens system. The light beam reflected by the rotating polygon mirror 62 is converged in the main scanning direction of the photoreceptor 11 by transmission through the fθ lens 68 and is converged in the secondary scanning direction by a cylinder lens not shown in Figure, whereby an image is formed on the photoreceptor 11.

The light source 53Y, 53 M, or 53C is not particularly limited as long as it can emit light at a predetermined definition and intensity having a wavelength that enables the toner particles in the region to be colored in the toner image to maintain the color-developing or non-color-developing state.

However, irradiation of the toner with the light emitted from the light source 53, i.e., irradiation for providing coloring information, should be performed at an intensity that is significantly higher than that for forming an electrostatic latent image by the exposure device 14. Specifically, the energy amount of the light that provides coloring information should be approximately 1,000 times greater than the exposure amount (2 $mJ/m^2$) on the photoreceptor used in normal electrophotographic process. As a result, a light source 53 should be a light source that can emit light at an intensity that is higher than that of the light for forming an electrostatic latent image.

For example, the exposure amount of the light needed for providing coloring information to the toner is preferably in the range of 0.05 to 0.8 $mJ/cm^2$, more preferably in the range of 0.1 to 0.6 $mJ/cm^2$. The exposure amount needed is correlated with the amount of the developed toner, and, for example, irradiation in the range of 0.2 to 0.4 $mJ/m^2$ is preferable when the developing toner amount (solid image) is approximately 5.5 $g/m^2$.

Examples of the light source 53Y, 53M, or 53C that can achieve such an exposure amount include LED image bar, laser ROS, and the like. The irradiation spot diameter of the light irradiated on the toner image on photoreceptor 11 is preferably adjusted to be in the range of 10 to 300 μm, more preferably in the range of 20 to 200 μm, so that the definition of the image falls in the range of 100 to 2,400 dpi.

The wavelength of the light that provides coloring information to the F toner is determined by the material design of the toner to be used, as described above. For example, light at 405 nm (λA light) may be irradiated at the desired position to prevent development of yellow (Y color); light at 535 nm (λB light) may be irradiated at the desired position to prevent development of magenta (M color); and light at 657 nm (λC light) may be irradiated at the desired position to prevent development cyan (C color). Thus, in an embodiment, the region to be colored in yellow in the toner image is exposed to λB and λC lights, which have wavelengths that inhibit magenta and cyan color development, respectively; the region to be colored in magenta in the toner image is exposed to λA and λC lights, which have wavelengths that inhibit yellow and cyan color development, respectively; the region to be colored in cyan in the toner image is exposed to λA and λB lights, which have wavelengths that inhibit yellow and magenta color development, respectively.

The lights above may be used in combination for development of a secondary color. In an exemplary embodiment, the λC light is irradiated at the region to be colored in red (R color); the λB light is irradiated at the region to be colored in green (G color); and the λA light is irradiated at the region to be colored in blue (B color). No light is irradiated at the region to be colored in black (K color), which is a tertiary color.

The light from the coloring information providing device 28 may be modulated as needed by a known image-modulating method, for example, by pulse width modulation, strength modulation, or combination thereof.

Hitherto described is the mechanism of forming a full-color image by using the coloring information providing device 28 according to an aspect of the present invention. However, in an aspect of the present invention, the providing of the coloring information by the coloring information providing device 28 may be included in formation of a monochrome image involving development of only one color of yellow, magenta, or cyan. In this case, only light having a specific wavelength related to the development of the desired color (e.g., yellow, magenta or cyan) is irradiated from the coloring information providing device 28. Other favorable conditions and the like are the same as those for forming a full-color image.

In the image-forming apparatus 10 shown in FIG. 1, coloring information is provided after development of an electrostatic latent image by the developing device 16 but before transfer of the toner image onto the recording medium 26. However, the timing of providing the coloring information is not limited thereto, and may be other timing before the toner image transferred onto the recording medium 26 is fixed. For example, the coloring information may be provided to the toner image which has been transferred on the recording medium 26.

However, application of the coloring information onto the toner image which has been transferred on the recording medium 26 could cause problems in the surface smoothness of the recording medium 26, the accuracy of the coloring position in the desired image, and the like. Therefore, the application of coloring information is preferably performed after development of the electrostatic latent image by the developing device 16 but before transfer of the toner image onto the recording medium 26.

The toner image immediately after receiving the coloring information is in the uncolored state having an inherent uncolored tone. For example, when a sensitizing colorant is contained, the toner image has only the color tone of the colorant.

The transfer device 18 transfers the toner image on the photoreceptor 11 onto a recording medium 26.

Any one of known transfer devices may be used as the transfer device 18. For example, roll, brush, blade, or the like may be used in a contact system, and Corotron, Scorotron, Pin array charger, or the like may be used in a non-contact system. In an exemplary embodiment, the toner image is transferred by pressure or by pressure and heat.

The transfer bias may be in the range of 300 to 1,000 V (absolute value), and an alternate current (Vpp: 400 V to 4 kV, 400 to 3 kHz) may be superposed.

When the recording medium 26 stored in a recording medium-supplying unit not shown in the Figure is fed to the position at which the recording medium 26 is held between the photoreceptor 11 and the transfer device 18, and is conveyed in the state of being nipped between the photoreceptor 11 and the transfer device 18, the toner image on the photoreceptor 11 is transferred onto the recording medium 26.

The fixing device 22 fixes the toner image transferred on the recording medium 26 when the recording medium 26 is transported along the transportation path 21 to the position at which the fixing device 22 is disposed.

The fixing device 22 has also a role as a color-developing device developing the color of the toner image (color-developing unit), and the photoirradiation device 24 described below may also be used as the color-developing device additionally.

The toner image after being provided with the coloring information, in which the toner has deprived of the ability to develop a specific color, assumes color when heat is applied with the fixing device 22.

Any one of known fixing units may be used as the fixing device 22. For example, the heating member or the pressurizing member may be a roll or a belt, and the heat source for use may be a halogen lamp, IH, or the like. The fixing device is compatible with various paper-transportation passes such as a straight pass, a rear C pass, a front C pass, an S pass, and a side C pass.

In the present embodiment, the fixing device 22 allows the toner image transferred on the recording medium 26 to color, as well as fixes the transferred image on the recording medium 26. However, the coloring process and the fixing may be performed separately.

In this case, a separate color-developing device that colors each toner constituting the toner image transferred on the recording medium 26 may be installed.

The location of the color-developing device installed is not particularly limited, and may be, for example, a position at which the color-developing device can allow the toner image to assume color before the toner image is fixed on the recording medium 26 with the fixing device 22.

When separate devices conduct the color development of the toner image transferred on the recording medium 26 and the fixing of the image on the recording medium 26, respectively, it becomes possible to separately control the heating temperature for the color development and the heating temperature for fixing the toner on the recording medium 26, whereby the degree of freedom is heightened in designing the coloring material, toner binder material, and the like.

In this case, various color-developing methods are available in accordance with the coloring mechanism of the toner particles. For example, when the toner is colored by curing or decomposing a coloring-related substance in the toner through irradiation with light having a wavelength that is outside the above-mentioned specific wavelength range, a light emitting apparatus that emits the light having the wavelength may be used. As an alternative, the F toner may be colored by using a pressure-applying apparatus that applies pressure to break encapsulated coloring particles.

However, because the chemical reaction occurring in the F toner when the F toner to which the coloring information is provided assumes color, is slow because the reaction involves migration and diffusion, which proceeds slowly in general. Therefore, it is necessary to provide sufficient diffusion energy regardless of which method is used. For this reason, a method of accelerating color-developing reaction by heating is most advantageous for color development of the F toner. Accordingly, the coloring of the toner image transferred on the recording medium 26 and the fixing of the toner image on the recording medium 26 are preferably performed by the fixing device 22 from the viewpoint of reduction in space.

The photoirradiation device 24 fixes the color developed on the toner fixed on the recording medium 26. The photoirradiation device 24 can decompose or inactivate the reactive substances remaining in the color-developing region that is controlled to be unable to assume color. Thus, the photoirradiation device 24 ensures prevention of the variation in color balance after image formation more, and removes or bleaches the background color.

In the present embodiment, the photoirradiation above is performed after the toner image is fixed on the recording medium 26. However, when a fixing method not involving heat-melting, for example a pressure fixing method by using pressure, is used as the fixing method, the photoirradiation by the photoirradiation device 24 may be performed before the toner image is fixed on the recording medium 26.

The photoirradiation device 24 may have a configuration allowing irradiation of light that can inhibit the progress of the color developing reaction of the toner, and any one of known lamps such as fluorescent lamp, LED, or EL may be used.

The light from the photoirradiation device 24 may have a wavelength distribution that includes the three wavelengths for causing coloration of the F toner; the illuminance may be in the range of approximately 2,000 to 200,000 lux; and the exposure period may be in the range of 0.5 to 60 sec.

In the image-forming apparatus 10 of the present exemplary embodiment, the toner image formed on the photoreceptor 11 is transferred onto the recording medium 26. In another embodiment, the toner image formed on the photoreceptor 11 is transferred onto an intermediate transfer body such as intermediate transfer belt, and then the toner image transferred on the intermediate transfer body is transferred again onto a recording medium 26.

In the image-forming apparatus 10 according to an aspect of the present invention, as described above, the coloring information applied to the toner is held stably during the period from the application of the coloring information to each toner constituting the toner image with the coloring information providing device 28 to the coloration of the toner with the fixing device 22. Therefore, it is not necessary to consider the period from the provision of the coloring information to the coloration, so that the image-forming apparatus 10 is compatible with a design in a wider speed range.

Specifically, the linear velocity is preferably in the range of 10 to 500 mm/sec, more preferably in the range of 50 to 300 mm/sec. When an image is formed at such a linear velocity, the exposure period for providing coloring information may be set to a value determined from the linear velocity and the definition.

Reliable storage of the coloring information in the toner is advantageous for the stability of the color tone of the image and reproducibility of highlighted images, thus contributing to high-quality high-accuracy reproduction of a full-color image from inputted image information.

The image-forming apparatus 10 also has a system control unit 32 that controls the entire image-forming apparatus 10. The system control unit 32 is connected to the exposure device 14 and the coloring information providing device 28 such that data and signal can be sent and received. The system control unit 32 is connected also to various devices installed in the image-forming apparatus 10 such that data and signal can be sent and received.

Figure 4:
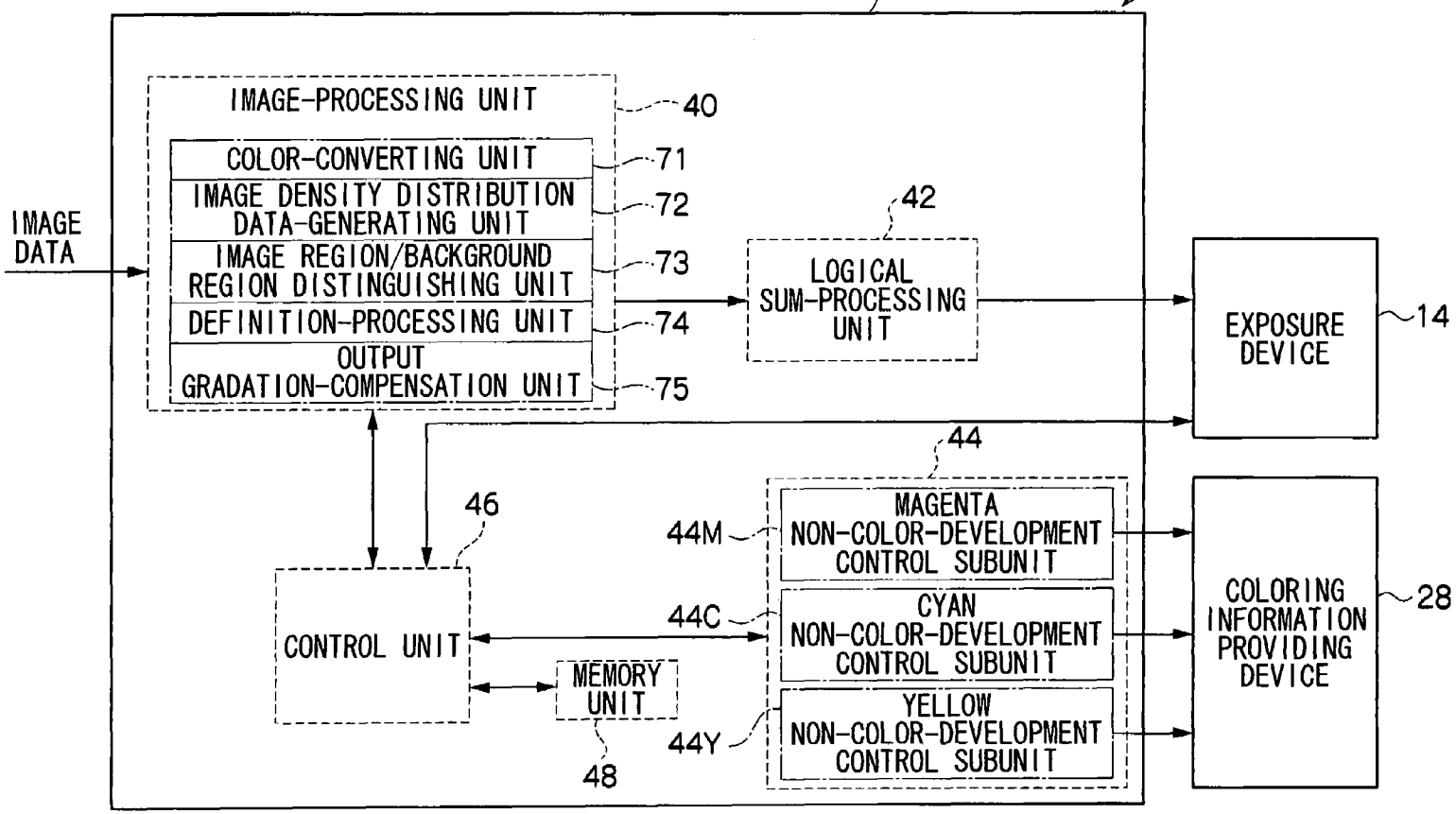
FIG. 4 is a schematic view illustrating the electric configuration of an image-forming apparatus.
Figure 5:
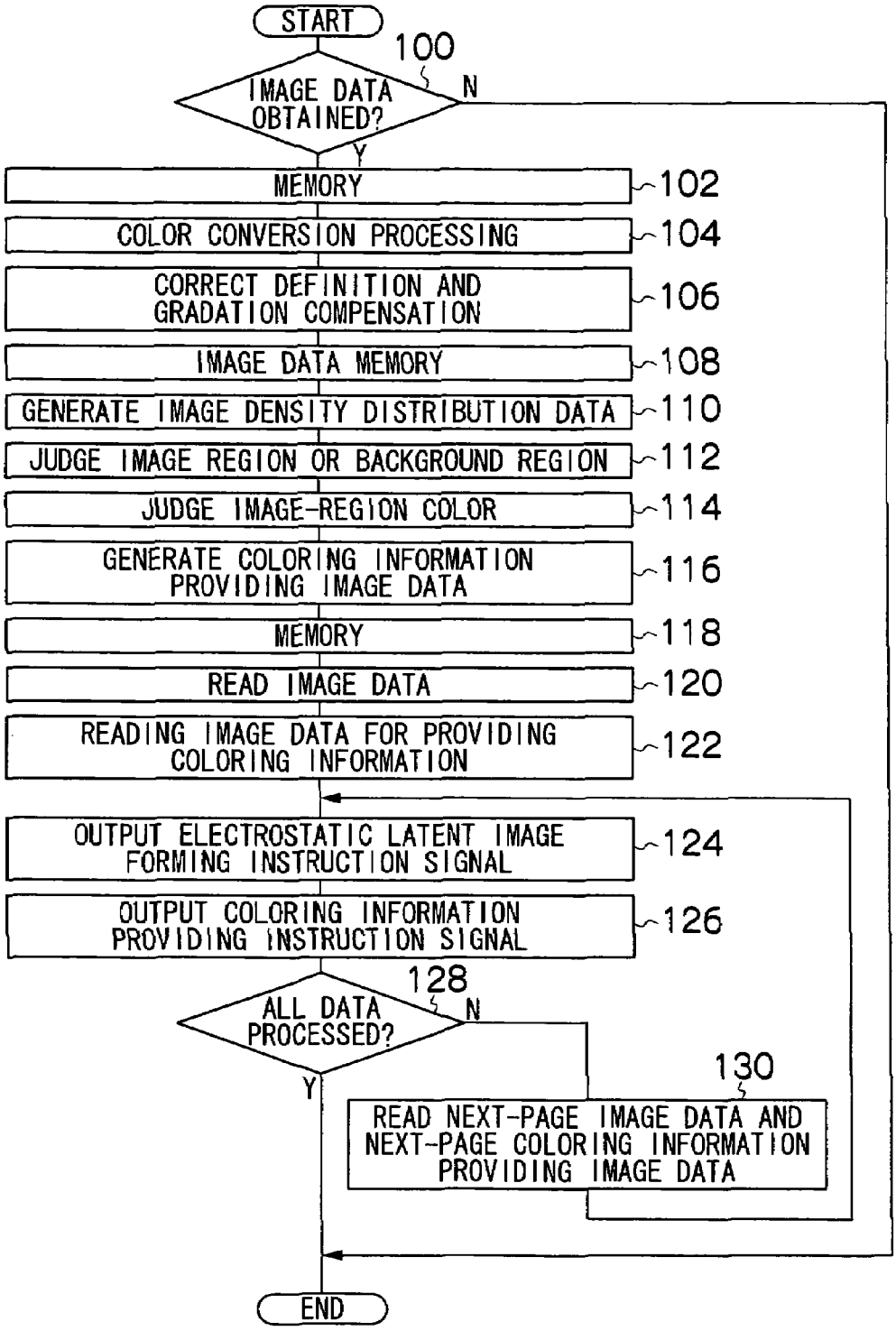
FIG. 5 is a flowchart showing processes executed in a control unit of an image-forming apparatus according to an aspect of the present invention.

As shown in FIG. 4, the system control unit 32 has an image-processing unit 40, a logical sum-processing unit 42, a non-color-development control unit 44, a memory unit 48, and a control unit 46.

The image-processing unit 40, non-color-development control unit 44, and memory unit 48 are respectively connected to the control unit 46 such that data and signal can be sent and received. The control unit 46 is also connected to the exposure device 14 and the coloring information providing device 28 such that data and signal can be sent and received. The control unit 46 controls the devices in the image-forming apparatus 10.

The memory unit 48 stores the processing routines and various data described below, and also stores, in advance, the following pieces of information such that they are correlated to each other: information on the respective color-developing regions contained in the F toner stored in the developing device 16, saturated light amount information representing the saturated color-development light amount of each respective color-developing region, and information on the light sources that emit the lights having the wavelengths corresponding to the maximum spectral sensitivities (Y light source 53Y, M light source 53 M, and C light source 53C).

The image-processing unit 40 has a color-converting unit 71, an image density distribution data-generating unit 72, an image region/background region distinguishing unit 73, a definition-processing unit 74, and an output gradation-compensation unit 75.

When the image data inputted into the image-forming apparatus 10 is PDL data, the color-converting unit 71 converts the data into raster image data, and also converts the image data in the RGB color space into device-independent image data in the L*a*b* color space and then into image data in the YMC color space.

In the description below, the image data inputted into the image-forming apparatus 10 is assumed to contain size information indicating the size of the recording medium 26 on which the image contained in the image data is formed. The image data may be inputted from an external device (not shown in Figure) disposed outside the image-forming apparatus 10 to the image-forming apparatus 10 via cable communication network or wireless communication network and an input/output unit (not shown in the Figure). As an alternative, the image date may be inputted to the image-forming apparatus 10 via an image data-reading unit (not shown in the Figure) additionally installed in the image-forming apparatus 10.

The conversion from the data in the RGB color space to the data in the L*a*b* color space is performed, for example, by using a three-dimensional lookup table (DLUT: three-dimensional color-compensating LUT) that has been memorized previously. The conversion from the data in L*a*b* color space to the data in YMC color space may be performed by using a printer model correlating the value in L*a*b* color space with that in YMC color space previously prepared with the color patch outputted from the output gradation-compensation unit 75 described below. The printer model may be prepared, for example, by neural network, multiple regression, or Neugebauer's theoretical equation, and the method is not limited. The color-converting unit 71 converts data in the RGB color space into data in YMC color space according to the printer model thus prepared.

The image density distribution data-generating unit 72 prepares image density distribution data showing distribution of image density when the image contained in the image data is formed on the recording medium of the size designated by size information, the size information indicating the size of the recording medium on which the outputted image is formed, and the size information being contained in the image data inputted into the image-processing unit 40.

The image region/background region distinguishing unit 73 differentiates the image region on the photoreceptor 11 where toner image is formed corresponding to the recording medium 26 having the size indicated by the size information designating the size of the recording medium 26 on which the image contained in the image data is to be formed, and the background region, i.e., non-image region, where no toner image is formed, the differentiation being conducted based on the image density distribution data prepared in the image density distribution data-generating unit 72.

Differentiation of the image and background regions by the image region/background region distinguishing unit 73 gives, for example, information showing the location and the shape of the image region in the area corresponding to the recording medium 26 on the photoreceptor 11 and information showing the location and the shape of the background region. The image-region information and the background-region information obtained in the image region/background region distinguishing unit 73 are stored in the memory unit 48 under control of the control unit 46 described below.

The image in the "image region" is an image such as graphic, image, or text contained in the image represented by the image data inputted into the image-processing unit 40.

The definition-processing unit 74 subjects the image data, for example, to a smoothening process that smoothens the image or to a strengthening process that strengthens the image. The output gradation-compensation unit 75 performs nonlinear gamma conversion processing for each color data according to the output characteristics optimized depending on the dot shape or the kind of the recording medium, which have been smoothened or strengthened in the definition-processing unit 74, for example, according to the output characteristics. The gamma conversion processing may be performed, for example, based on a one-dimensional lookup table (LUT).

The image data processed in the image-processing unit 40 under control of the control unit 46 is inputted to the logical sum-processing unit 42. When the image data is inputted from the image-processing unit 40, the logical sum-processing unit 42 calculates the logical sum of the CMY data from the pixel data for each pixel constituting the image contained in the image data, and outputs the calculated logical sum data to the exposure device 14.

The exposure device 14 irradiates the surface of the photoreceptor 11 based on the inputted logical sum data. As a result, an electrostatic latent image corresponding to the image designated by the image data is formed on the surface of the photoreceptor 11 by photoirradiation by the exposure device 14.

Based on the image data processed in the image-processing unit 40, the control unit 46 prepares coloring information providing data that provides coloring information (described below in detail).

The non-color-development control unit 44 has a magenta non-color-development control subunit 44M that controls non-development of magenta color, a cyan non-color-development control subunit 44C that controls non-development of cyan color, and a yellow non-color-development control subunit 44Y that controls non-development of yellow color.

In the present embodiment, the non-color-development control unit 44 has non-color-development control subunits that control the color-developing reactions for cyan, magenta, and yellow. However, the non-color-development control unit 44 may have control subunits whose number is suitable for the kinds of the light sources 53 (in the present embodiment, Y light source 53Y, M light source 53 M, and C light source 53C), and the number of the control subunits is not limited to the above example. For example, when the image-forming apparatus 10 has an additional light source as a light source 53 that emits light at a specific wavelength for making the F toner unable to develop black color, the control unit may have an additional non-black-development control subunit.

Color component information indicating the color not to be developed is inputted from the control unit 46 to each of the magenta non-color-development control subunit 44 M, cyan non-color-development control subunit 44C, and yellow non-color-development control subunit 44Y, though detailed description is omitted. The inputted data is outputted to the coloring information providing device 28 under control of the control unit 46.

The light sources 53 (light sources 53Y, 53M, and 53C) in the coloring information providing device 28 are controlled to emit light at a predetermined wavelength that prevents development of the color designated by the color component information for each pixel under control of the control unit 46 based on the inputted color component information for each pixel.

As described above, in the image-forming apparatus 10 according to an aspect of the present invention, an electrostatic latent image corresponding to image data is formed on the photoreceptor 11 under the control of the control unit 46 while coloring information can be provided to each toner constituting a developed toner image corresponding to the electrostatic latent image under the control of the control unit 46.

Hereinafter, processes executed in the control unit 46 of the image-forming apparatus will be described.

In the control unit 46, the processing routine shown in FIG. 4 is executed at a particular time interval, and advances to Step 100.

In Step 100, it is judged whether image data for an image formed in the image-forming apparatus 10 is inputted from outside the image-forming apparatus 10 via an input/output port (not shown in Figure); and the routine terminates if the answer is negative, while, if the answer is positive, the processing advances to Step 102 where the inputted image data is stored in the memory unit 48.

In the next Step 104, instruction signals for generation of a raster image and for converting the RGB image data are outputted to the color-converting unit 71. Upon receiving the instruction signals for generating the raster image and the conversion, the color-converting unit 71 converts the image data obtained in Step 100 (PDL data) into raster image data, and also converts the image data in the RGB color space to device-independent image data in the L*a*b* color space, and further converts the image data obtained to the image data in the YMC color space.

In the next Step 106, instruction signals demanding definition processing and execution of output gradation compensation are outputted respectively to the definition-processing unit 74 and the output gradation-compensation unit 75.

Upon receiving the instruction signal demanding execution of definition processing the definition-processing unit 74 performs, for example, a smoothening process that smoothens the image or a strengthening process that strengthens the image on the image data converted in Step 104.

Upon receiving the instruction signals demanding output gradation compensation, the output gradation-compensation unit 75 performs nonlinear gamma conversion on the signals for each color with respect to the image-forming region optimized depending on the dot shape and the kind of recording medium, which have been smoothened or strengthened in the definition-processing unit 74, for example, according to the output characteristics.

In the next Step 108, the image data processed in Step 106 is stored in the memory unit 48.

In the next Step 110, based on the image data stored in the memory unit 48 in Step 108, instruction signals demanding preparation of image density distribution data are outputted to the image density distribution data-generating unit 72. Upon receiving the instruction signals demanding preparation of the image density distribution data, the image density distribution data-generating unit 72 prepares image density distribution data indicating the distribution of the image density at the time the image designated by the image data is formed on a recording medium having a size designated by the size information based on the size information indicating the size of the recording medium 26 for image formation contained in the image data obtained in Step 100 and the image data that were stored in the memory unit 48 in Step 108.

In the next Step 112, judgment instruction signals instructing to differentiate image and background regions are outputted to the image region/background region distinguishing unit 73 based on the image density distribution data prepared in processing in Step 110.

Upon receiving the judgment instruction signals, the image region/background region distinguishing unit 73 differentiates the image region and the background region based on the image density distribution data prepared in the image density distribution data-generating unit 72, and prepares location information indicating the shape and the location of the image and background regions as data showing the image and background regions (image region data and background region data); the image region refers to the region in an area on the photoreceptor 11 on which region a toner image is formed, and the background region refers to a non-image region in the area on the photoreceptor 11 on which a toner image is not formed, the area on the photoreceptor 11 corresponding to the recording medium 26 having the size designated by the size information.

In the next Step 114, the color of each pixel constituting the image region judged in Step 112 is determined based on the image data stored in the memory unit 48 in Step 108 by reading color component information contained in the pixel data for the pixel at the location corresponding to the image region.

In the next Step 116, image data that provide coloring information are prepared. The image data that provide coloring information, which are to be outputted to the coloring information providing device 28, contain color component information indicating the color(s) whose development should be inhibited.

In processing in Step 116, information indicating which light sources among the light source 53Y, 53 M, or 53C should be used for irradiating each pixel of the image region and information indicating the exposure amount are generated based on the image region information indicating the image region examined in Step 112 and the color component information indicating the color of each pixel of the image region examined in Step 114, such that each pixel of the image region develops the color designated by the color component information through irradiation of the corresponding position in the toner image formed on the photoreceptor 11 with light having a specific wavelength that prevents development of colors other than the color designated by the color component information.

In processing in Step 116, information about which light sources among the light source 53Y, 53M, or 53C should be used for irradiating the background region and information indicating the exposure amount are generated based on the background-region information indicating the background region and the image region information examined in Step 112, such that light having a specific wavelength that prohibits development of the color designated by the color component information for the each pixel of the image region is irradiated on the background region on the photoreceptor 11. The obtained information on the light sources 53 corresponding to the image region and background (light sources 53Y, 53M, and 53C) and the exposure amount is generated as the image data that provide coloring information.

In processing in Step 116, among the information on the light sources used for irradiating the background region among 53Y, 53M, or 53C and the information indicating the exposure amount, the information indicating the exposure amount can be generated by reading the saturated light amount information corresponding to the information indicating the light source(s) 53 for irradiating the background region.

In this way in the processing in Step 116, image data that provide coloring information are generated on the image region on the photoreceptor 11 based on the color component information on the image in image data. The image data that provide coloring information include information for irradiating light having a wavelength for preventing color development of the other colors than the color corresponding to the color component of the image region emitted from a light source 53 (light source 53Y, 53 M, and 53C) at a light amount corresponding to the coloring density, and information for irradiating light having a specific wavelength for prohibiting color development in the background region on photoreceptor 11 with respect to the colors of the image region at the saturated color-development light amount emitted from a light source 53 (light source 53Y, 53M, or 53C).

In the next Step 118, the image data that provide coloring information prepared in Step 116 are stored in the memory unit 48.

In the next Step 120, the image data that were stored in the memory unit 48 in Step 108 is read, and in the next Step 122, the image data for providing coloring information that was stored in the memory unit 48 in Step 118 is read.

In the next Step 124, electrostatic latent image forming instruction signals including the image data are outputted to the image-processing unit 40 and the exposure device 14 based on the image data read in Step 120 or in Step 130 described below as instruction signals for forming, on the photoreceptor 11, an electrostatic latent image corresponding to the image designated by the image data.

In the image-processing unit 40, when the electrostatic latent image forming instruction signals are inputted, logical sum data indicating the logical sum of the color component information for each pixel of the image designated by the image data contained in the inputted electrostatic latent image forming instruction signals are outputted to the exposure device 14. In the exposure device 14, an electrostatic latent image corresponding to the image designated by the image data that was obtained in Step 100 is formed on the photoreceptor 11 based on the inputted logical sum data by scanning exposure of the surface of the photoreceptor 11. When the electrostatic latent image formed on the photoreceptor 11 is transported to the region to face the developing rolls 16A in the developing device 16 by rotation of the photoreceptor 11, the electrostatic latent image is developed with the F toner, forming a toner image corresponding to the electrostatic latent image.

At this time, there are cases where the F toner deposits also on the region where there is an electrostatic latent image formed by the exposure device 14.

In the next Step 126, based on the coloring information providing information read in Step 122 or Step 130 described below, light having a particular wavelength for prohibiting development of the other colors than the color corresponding to the color component information of the image region is scan-irradiated to the image region in the toner image formed on the photoreceptor 11, and light having a specific wavelength for prohibiting development of the color corresponding to the color component information of the image region is scan-irradiated to the background region.

Light is irradiated to the image and background regions on the photoreceptor 11 by the coloring information providing device 28, and the rotation of the photoreceptor 11 causes the toner image with the coloring information to be transferred onto a recording medium 26 by the transfer device 18. The F toner deposited in the background region of the photoreceptor 11 is also transferred onto the recording medium 26 at the same time.

The F toner transferred on the recording medium 26 is fixed on the recording medium 26 under pressure applied by the fixing device 22, and the fixed image develops the color when heated according to the coloring information provided in Step 126.

In the next Step 128, it is judged whether the image-forming processing is completed for the full-page image data stored in the memory unit 48. If the answer is positive, the routine terminates. If the answer is negative, the processing advances to Step 130, and the image data and the image data for providing coloring information for the next page to the page so far processed are read in Steps 124 and 126, and the routine goes back to Step 124.

Figure 9A:
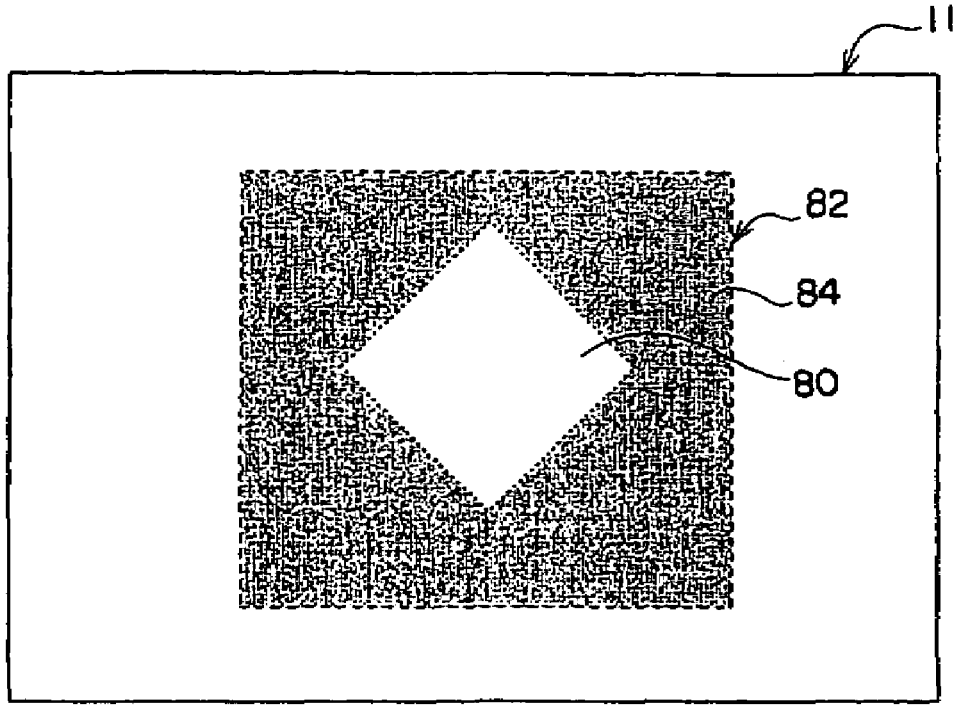
FIG. 9A is a schematic view illustrating an example of the surface state of the photoreceptor which has been exposed to light for providing coloring information in an image-forming apparatus according to an aspect of the present invention.

As shown in FIG. 9A, for example, by execution of the processing routine in the image-forming apparatus 10 according to an aspect of the present invention, when coloring information is provided from the coloring information providing device 28, light having a particular wavelength for prohibiting development of the other colors than the color to be developed in the image region 80 is irradiated to the image region 80, and light having a particular wavelength for prohibiting development of the color to be developed in the image region 80 is irradiated to the background region 84, which is the region in the region 82 other than the image region 80, the region 82 corresponding to the size of the recording medium 26 on which the image is to be formed. The reference character 11 in FIG. 9A represents a photoreceptor.

Specifically, when the F toner contains a Y color-developing region capable of developing Y color, an M color-developing region capable of developing M color, and a C color-developing region capable of developing C color and the color to be developed in the image region 80 is yellow, lights having wavelengths that prohibit color-developing reactions of the M color- and C-color developing regions are irradiated to the image region 80 at the saturated color-development amounts corresponding to the M color- and C color-developing regions, respectively. Also in the background region 84, light having a wavelength for prohibiting color-developing reaction of the Y color-developing region is irradiated at the saturated exposure amount corresponding to the Y color-developing region so as to prevent development of yellow color, which is the color to be developed in the image region 80.

Figure 9B:
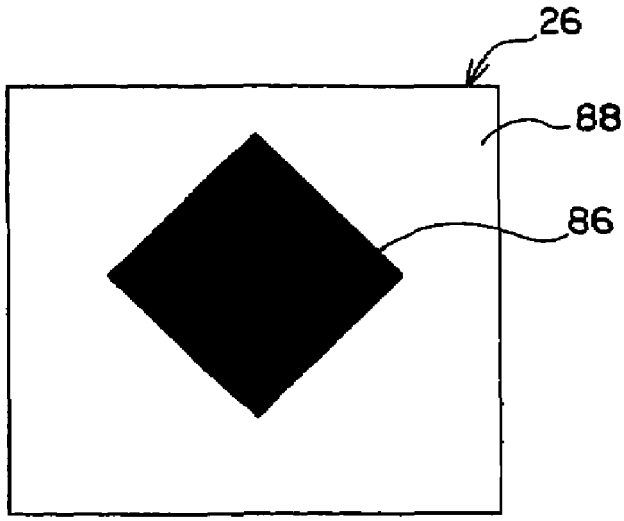
FIG. 9B is a schematic view illustrating the image formed on a recording medium through provision of coloring information as shown in FIG. 9A.

When such coloring information is provided and heat is applied to the recording medium 26 by the fixing device 22, as shown in FIG. 9B, a recording medium 26 is obtained on which the image 86 corresponding to the image region 80 is colored in Y color while the region 88 corresponding to the background region 84 is not colored in Y color.

Figure 10A:
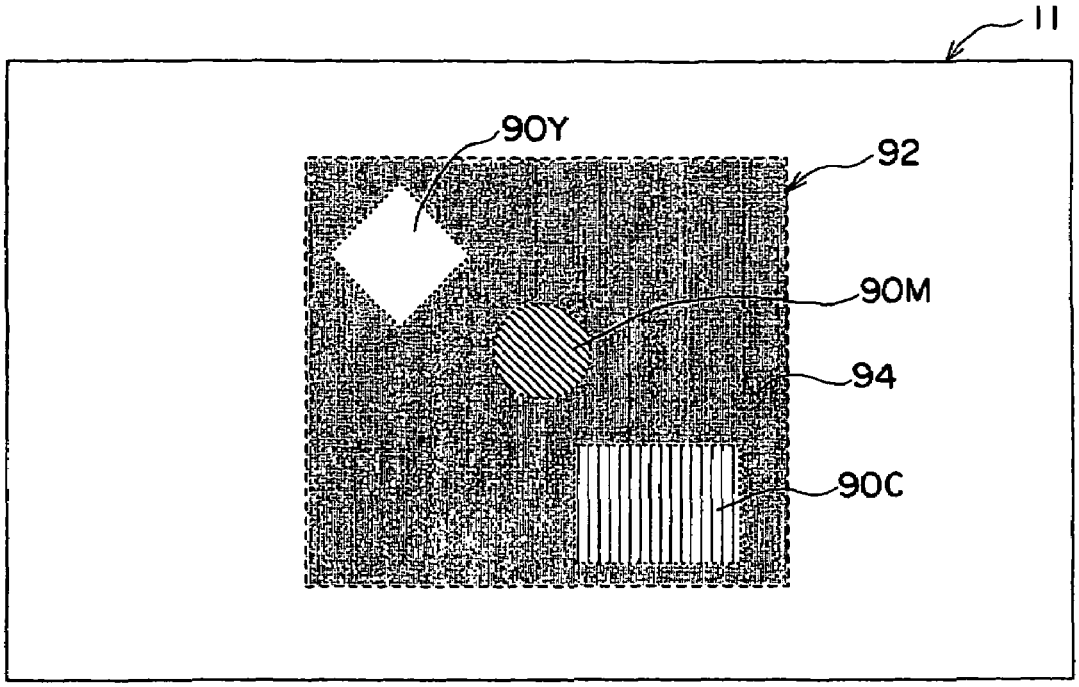
FIG. 10A is a schematic view illustrating an example of the surface state of the photoreceptor which has been exposed to light for providing coloring information in an image-forming apparatus according to an aspect of the present invention.

For example, when multiple images different in color from each other are formed in the recording medium 26, the following operations are conducted as a result of the processing routine executed in the image-forming apparatus 10, as shown in FIG. 10A: When the coloring information is provided from the coloring information providing device 28, each of the image region 90Y, 90M, or 90C is irradiated with light having a wavelength for prohibiting development of the other color than the color to be developed in the image region (90Y, 90M, or 90C), and the background region 94 is irradiated with lights having wavelengths for prohibiting development of all of the colors to be developed in the image regions 90Y, 90M, and 90C. The background region 94 is the other region in the region 92 than the image regions 90Y, 90M, and 90C, the region 92 having the size that is equivalent to the size of the recording medium 26 on which the image is to be formed. In FIG. 10A, the reference character 11 represents a photoreceptor.

Specifically, when the F toner contains a Y color-developing region capable of developing Y color, a M color-developing region capable of developing M color, and a C color-developing region capable of developing C color, the color to be developed in the image region 90Y is yellow, the color to be developed in the image region 90M is magenta, and the color to be developed in the image region 90C is cyan, lights having wavelengths for prohibiting the color-developing reactions of the M color- and C color-developing regions are irradiated to the image region 90Y at the saturated color-development light amounts corresponding to the M color- and G color-developing regions, respectively. Similarly, lights having wavelengths for prohibiting the color-developing reactions of the Y color- and C color-developing regions are irradiated to the image region 90M at the saturated color-development light amounts corresponding to the Y color- and C color-developing regions, respectively. Similarly, lights having wavelengths for prohibiting the color-developing reactions of the Y color- and M color-developing regions are irradiated to the image region 90C at the saturated color-development light amounts corresponding to the Y color- and M color-developing regions, respectively.

In addition, lights having wavelengths for prohibiting the color-developing reactions of the Y color-, M color-, and G color-developing regions are irradiated to the background region 94 at the saturated exposure amounts corresponding to the Y color-, M color-, and C color-developing regions, respectively, so as to prevent development of yellow, magenta, and cyan colors, which are the colors to be developed in the image regions 90Y, 90M, and 90C.

Figure 10B:
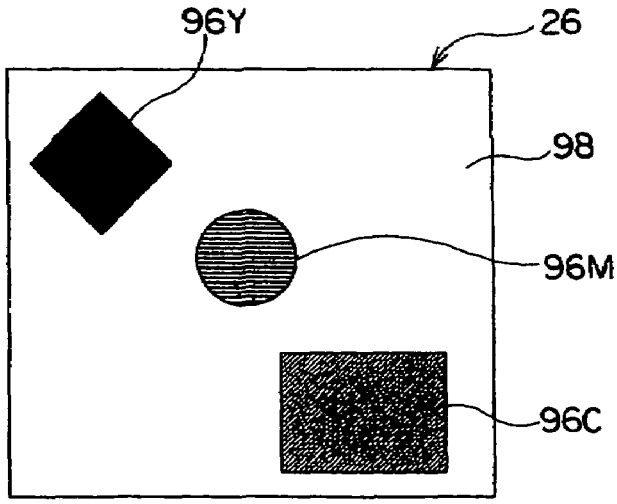
FIG. 10B is a schematic view illustrating the image formed on a recording medium through provision of coloring information as shown in FIG. 10A.

When such coloring information is provided and heat is applied to the recording medium 26 by the fixing device 22, as shown in FIG. 10B, a recording medium 26 is obtained on which the image 96Y corresponding to the image region 90Y is colored in Y color, the image 96M corresponding to the image region 90M is colored in M color, the image 96C corresponding to the image region 90C is colored in C color, and the region 98 corresponding to the background region 94 is not colored in any one of Y, M, and C color.

In the description of the embodiments above, the light exposure amount to the background region is the saturated color-development light amount corresponding to the color-developing region that is not to be colored. However, the light exposure amount to the background region is not limited to the saturated color-development light amount, and may be any amount that is not less than the saturated color-development light amount.

As described above, toner blemish (i.e., fogging due to toner) in the region on the recording medium 26 where an image should not be formed may be prevented by using the image-forming apparatus 10 according to an aspect of the present invention, which uses a toner that maintains the non-color-developing state when coloring information is provided by light. This is because the background region—the region on the photoreceptor 11 other than the image regions—can be irradiated with light having a wavelength for prohibiting the developments of the colors to be developed in the image region upon application of the coloring information.

The background region can be irradiated with lights for preventing the color-developing reactions in the color-developing regions capable of developing the colors that are not to be developed, respectively at exposure amounts not less than the saturated color-development light amounts. Therefore, it is possible to prevent color development of the toner deposited on the background region into the same color as the color developed by the toner in the image region, and the toner fogging in the background on the recording medium may be suppressed.

EXAMPLE 1

The following tests are performed to confirm the advantages of the embodiments above.

(Toner)

Non-photocoloring F toners containing color-developing regions (photo- and thermo-sensitive capsules) dispersed in a binder resin are prepared in the following manner.

—Preparation of Microcapsule Dispersion Liquid (1)—

8.9 parts by weight of an electron-donating colorless dye (1) capable of developing yellow color is dissolved in 16.9 parts of ethyl acetate, and 20 parts by weight of a capsular wall material (trade name: TAKENATE D-110N, manufactured by Takeda Pharmaceutical Company Limited.) and 2 parts by weight of another capsular wall material (trade name: MILLIONATE MR200, manufactured by Nippon Polyurethane Industry Co., Ltd.) are added thereto.

The solution obtained is added to a mixed solution containing 42 parts by weight of 8 wt % phthalated gelatin, 14 parts by weight of water, and 1.4 parts by weight of a 10 wt % sodium dodecylbenzenesulfonate solution, and the mixture is emulsified and dispersed at a temperature of 20° C., to give an emulsion liquid. Then, 72 parts by weight of an aqueous 2.9% tetraethylenepentamine solution is added to the emulsion liquid obtained; the mixture is heated to 60° C. while stirred, to give a microcapsule dispersion liquid (1) in 2 hours. The microcapsules contained in the microcapsule dispersion liquid (1) have an average particle diameter of 0.5 μm and contain an electron-donating colorless dye (1) in the core region.

The glass transition temperature of the material constituting the shell of the microcapsules contained in the microcapsule dispersion liquid (1) (material prepared in reaction of TAKENATE D-110N and MILLIONATE MR200 under a condition almost the same as that described above) is 100° C.

—Preparation of Microcapsule Dispersion Liquid (2)— a microcapsule dispersion liquid (2) is prepared in the same manner as the preparation of the microcapsule dispersion liquid (1), except that the electron-donating colorless dye (1) is replaced with an electron-donating colorless dye (2). The average particle diameter of the microcapsules in the dispersion liquid is 0.5 μm.

—Preparation of Microcapsule Dispersion Liquid (3)—

A microcapsule dispersion liquid (3) is prepared in the same manner as the preparation of the microcapsule dispersion liquid (1), except that the electron-donating colorless dye (1) is replaced with an electron-donating colorless dye (3). The average particle diameter of the microcapsules in the dispersion liquid is 0.5 μm. The chemical structures of the electron-donating colorless dyes (1) to (3) used in the preparation of the microcapsule dispersion liquids are shown below.

Electron-donating colorless dye (1)

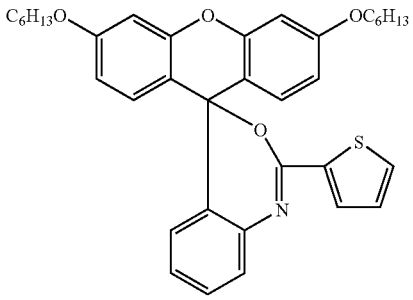

Electron-donating colorless dye (2)

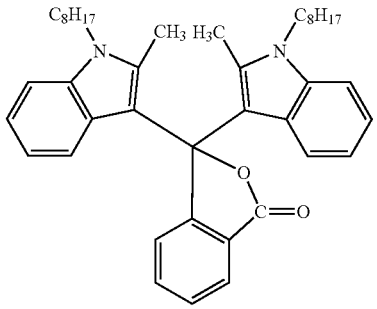

-continued

Electron-dontaing colorless dye (3)

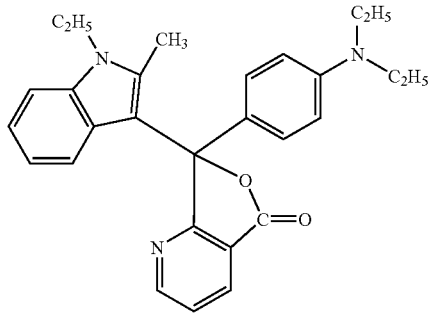

—Preparation of Photocurable Composition Dispersion Liquid (1)—

100.0 parts by weight of a mixture of polymerizable group-containing electron-accepting compounds (1) and (2) (blending ratio: 50:50) and 0.1 part by weight of a thermal polymerization inhibitor (ALI) are dissolved in 125.0 parts by weight of isopropyl acetate (solubility in water: approximately 4.3%) at 42° C., to give a mixture solution I.

18.0 parts by weight of hexaarylbiimidazole (1) [2'2'-bis (2-chlorophenyl)-4,4',5,5'-tetraphenyl-1,2'-biimidazole], 0.5 part by weight of a nonionic organic colorant, and 6.0 parts by weight of an organic boron compound are added to and dissolved in the mixture solution I at 42° C., to give a mixture solution II.

The mixture solution II is added to a mixture solution of 300.1 parts by weight of an aqueous 8 wt % gelatin solution and 17.4 parts by weight of an aqueous 10 wt % surfactant (1) solution. Then, the resultant mixture is emulsified in a homogenizer (manufactured by Nippon Seiki Co., Ltd.)) at a rotational speed of 10,000 rpm for 5 minutes, and then the solvent is removed at 40° C. over 3 hours, to give a photocurable composition dispersion liquid (1) having a solid content of 30 wt %. The structural formulae of the polymerizable group-containing electron-accepting compound (1), the polymerizable group-containing electron-accepting compound (2), the thermal polymerization inhibitor (ALI), the hexaarylbiimidazole (1), the surfactant (1), the nonionic organic colorant, and the organic boron compound used in the preparation of the photocurable composition dispersion liquid (1) are shown below.

Polymerizable group-containing electron-accepting compound

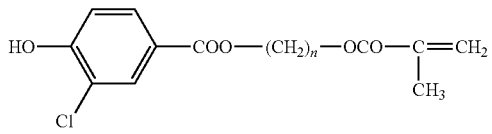

$n = 5$ (1)
$n = 6$ (2)

-continued

ALI

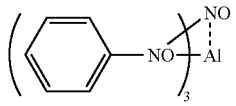

Surfactant (1)

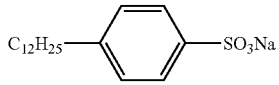

Hexaarylbiimidazole (1)

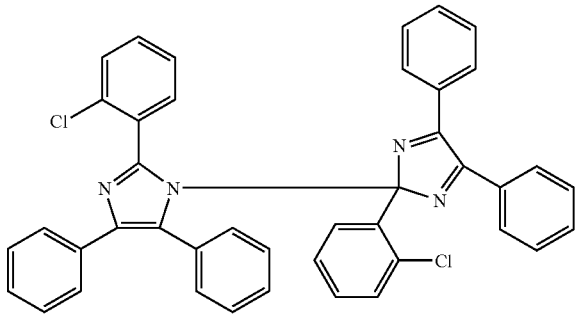

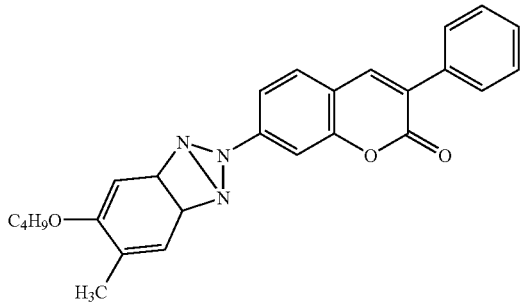

Nonionic organic colorant

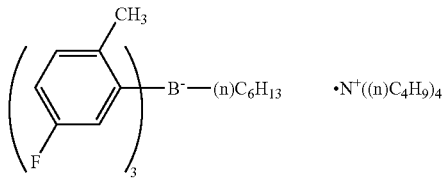

Organic boron compound

—Preparation of Photocurable Composition Dispersion Liquid (2)—

Five parts by weight of the following polymerizable group-containing electron-accepting compound (3) is added to a mixture solution of 0.6 part by weight of the following organic borate compound (I), 0.1 part by weight of the following spectral sensitizing colorant borate compound (I), 0.1 part by weight of the following assistant (1) for improvement in sensitivity, and 3 parts by weight of isopropyl acetate (solubility in water: approximately 4.3%).

Organic borate compound (I)

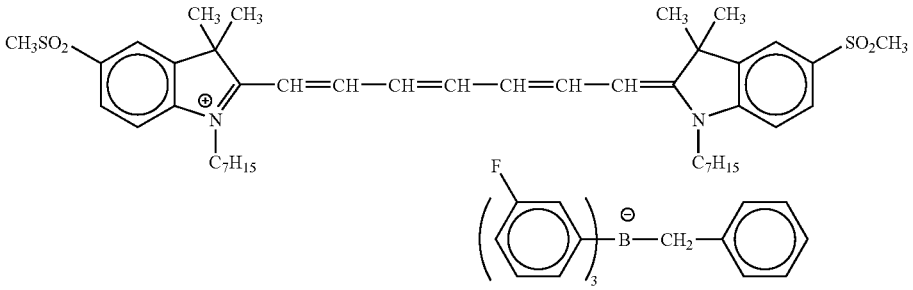

Spectral sensitizing colorant borate compound (I)

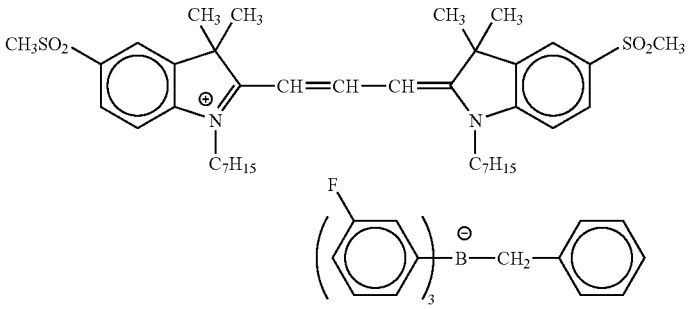

Spectral sensitizing colorant borate compound (II)

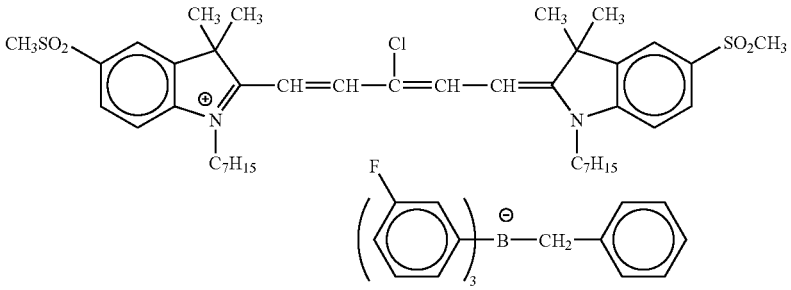

The solution obtained is added to a mixture solution of 13 parts by weight of an aqueous 13 wt % gelatin solution, 0.8 part by weight of the following aqueous 2 wt % surfactant (2) solution, and 0.8 part by weight of the following aqueous 2 wt % surfactant (3) solution. The resultant mixture is emulsified in a homogenizer (manufactured by Nippon Seiki Co., Ltd.) at a rotational speed of 10,000 rpm for 5 minutes, to give a photocurable composition dispersion liquid (2).

The structural formulae of the polymerizable group-containing electron-accepting compound (3), the assistant (1), the surfactant (2) and the surfactant (3) used in the preparation of the photocurable composition dispersion liquid (2) are shown below.

Polymerizable group-containing electron-accepting compound (3)

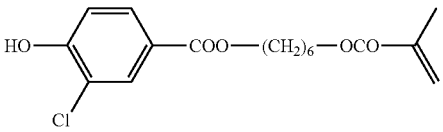

-continued

Assistant (1)

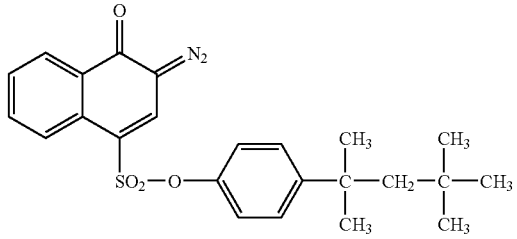

Surfactant (2)

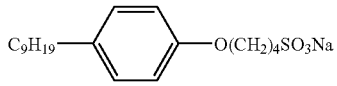

-continued

Surfactant (3)

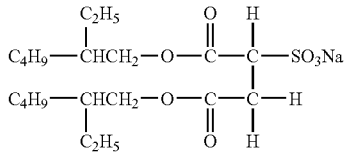

—Preparation of Photocurable Composition Dispersion Liquid (3)—

A photocurable composition dispersion liquid (3) is prepared in the same manner as the preparation of the photocurable composition dispersion liquid (2), except that the spectral sensitizing colorant borate compound (I) is replaced with 0.1 part by weight of the spectral sensitizing colorant borate compound (II) shown above.

—Preparation of Resin Particle Dispersion Liquid—

Styrene: 460 parts by weight n-butyl acrylate: 140 parts by weight

Acrylic acid: 12 parts by weight

Dodecanethiol: 9 parts by weight

The components above are mixed and dissolved to give a solution. Then, the solution is added to a solution of 12 parts by weight of an anionic surfactant (DOW-FAX, manufactured by Rhodia) in 250 parts by weight of ion-exchange water, and the mixture is dispersed and emulsified in a flask, to give an emulsion liquid (monomer emulsion liquid A). The monomer emulsion liquid A is placed in a polymerization flask.

Separately, 1 part of an anionic surfactant (DOW-FAX, manufactured by Rhodia) is dissolved in 555 parts by weight of ion-exchange water, and the solution is added to the polymerization flask. The polymerization flask is sealed tightly and equipped with a reflux condenser, and the mixture in the flask is heated to 75° C. using a water bath and kept at the same temperature while being stirred gently and being supplied with nitrogen.

Then, a solution containing 9 parts of ammonium persulfate dissolved in 43 parts by weight of ion-exchange water is added dropwise into the polymerization flask by a metering pump over a period of 20 minutes, and additionally, the monomer emulsion liquid A is added dropwise by a metering pump over a period of 200 minutes.

The mixture is then stirred gently for 3 hours while the polymerization flask is kept at 75° C., to complete polymerization. As a result, a resin particle dispersion liquid is obtained which contains particles having a median diameter of 210 nm, a glass transition point of 51.5° C., a weight-average molecular weight of 31,000, and a solid content of 42 wt %.

—Preparation of Photo- and Thermo-Sensitive Capsule Dispersion Liquid (1)—

Microcapsule dispersion liquid (1): 150 parts by weight

Photocurable composition dispersion liquid (1): 300 parts by weight

Polyaluminum chloride: 0.20 part by weight

Ion-exchange water: 300 parts by weight

A raw material solution containing the components above is adjusted to a pH of 3.5 by addition of nitric acid. The raw material solution is sufficiently mixed and dispersed in a homogenizer (ULTRA-TURRAX-50, manufactured by IKA) and then is transferred into a flask. The mixture is heated to 40° C. and kept at 40° C. for 60 minutes in a heating oil bath while stirred with a Three One Motor. 300 parts by weight of the resin particle dispersion liquid is further added, and the mixture is stirred gently at 60° C. for 2 hours to give a photo- and thermo-sensitive capsule dispersion liquid (1). The volume-average particle diameter of the photo- and thermo-sensitive capsules dispersed in the dispersion liquid is 3.53 μm. There is no spontaneous coloring of the dispersion liquid during the preparation thereof.

—Preparation of Photo- and Thermo-Sensitive Capsule Dispersion Liquid (2)—

Microcapsule dispersion liquid (2): 150 parts by weight

Photocurable composition dispersion liquid (2): 300 parts by weight

Polyaluminum chloride: 0.20 part by weight

Ion-exchange water: 300 parts by weight

A photo- and thermo-sensitive capsule dispersion liquid (2) is prepared in the same manner as the preparation of the photo- and thermo-sensitive capsule dispersion liquid (1), except that the components above are used as the raw material solution. The volume-average particle diameter of the photo- and thermo-sensitive capsules dispersed in the dispersion liquid is 3.52 μm. There is no spontaneous coloring of the dispersion liquid during the preparation thereof.

—Preparation of Photo- and Thermo-Sensitive Capsule Dispersion Liquid (3)—

Microcapsule dispersion liquid (3): 150 parts by weight

Photocurable composition dispersion liquid (3): 300 parts by weight

Polyaluminum chloride: 0.20 part by weight

Ion-exchange water: 300 parts by weight

A photo- and thermo-sensitive capsule dispersion liquid (3) is prepared in the same manner as the preparation of the photo- and thermo-sensitive capsule dispersion liquid (1), except that the components above are used as the raw material solution. The volume-average particle diameter of the photo- and thermo-sensitive capsules dispersed in the dispersion liquid is 3.47 μm. There is no spontaneous coloring of the dispersion liquid during the preparation thereof.

—Preparation of Toner—

Photo- and thermo-sensitive capsule dispersion liquid (1): 750 parts by weight

Photo- and thermo-sensitive capsule dispersion liquid (2): 750 parts by weight

Photo- and thermo-sensitive capsule dispersion liquid (3): 750 parts by weight

A mixture solution of the above dispersion liquids is placed in a flask, heated to 42° C. in a heating oil bath, and kept at 42° C. for 60 minutes while stirred. 100 parts by weight of the resin particle dispersion liquid is added thereto, and the mixture is stirred gently.

Then, the pH in the flask is adjusted to 5.0 by addition of an aqueous 0.5 mole/liter sodium hydroxide solution, and the mixture is heated to 55° C. while stirred. The pH in the flask is maintained at more than 4.5 by further addition of the aqueous sodium hydroxide solution; otherwise, the pH in the flask would decrease to 5.0 or less during the heating to 55° C. normally. The mixture is left at 55° C. for 3 hours in this state.

After the completion of the reaction, the mixture is cooled, filtered, washed sufficiently with ion-exchange water, and is subjected to a Nuche suction filtration so as to achieve liquid/solid separation. The solid is redispersed in 3 liters of ion-exchange water in a 5-liter beaker at 40° C., stirred at 300 rpm for 15 minutes, and washed. This washing operation is repeated five times. Then the resulting product is subjected to a Nuche suction filtration to perform solid/liquid separation. Thereafter, the product is freeze-dried for 12 hours to give toner particles containing photo- and thermo-sensitive capsules dispersed in a styrene resin. The particle diameter of the toner particles is determined with a Coulter Counter, and the volume-average particle diameter D50v is found to be 15.2 μm. Then, 1.0 part by weight of hydrophobic silica (TS720, manufactured by Cabot) is added to 50 parts by weight of the toner particles, and the silica and the toner particles are mixed in a sample mill to give a toner carrying the external additive.

(Developer)

A mixture of 30 wt % of a styrene-acryl copolymer (number-average molecular weight: 23,000, weight-average molecular weight: 98,000, Tg: 78° C.) and 70 wt % of granular magnetite (maximum magnetization: 80 emu/g, average particle diameter: 0.5 μm) is kneaded, pulverized, and then classified to give particles having a volume average particle diameter of 100 μm. The particles obtained are added as a carrier to the toner obtained above such that the toner concentration becomes 5 wt %. The toner and the carrier are mixed in a ball mill for 5 minutes to give a developer 1.

(Image Formation)

An image-forming apparatus similar to that shown in FIG. 1 is prepared, and the developer is filled in the developing device 16. The photoreceptor 11 is prepared as follows: an electrically conductive ITO layer is formed on the surface of a cylindrical glass transparent base material (as a conductive substrate) by sputtering, and a multilayer organic photosensitive layer as a photosensitive layer is formed on the conductive layer by coating. The multilayer organic photosensitive layer includes a charge-generating layer of gallium chloride phthalocyanine and a charge transport layer of N,N'-diphenyl-N,N'-bis(3-methylphenyl)-[1,1']biphenyl-4,4'-diamine, and has a thickness of 25 μm.

The charging device 12 used in this Example is Scorotron.

The exposure light source (not shown in Figure) used in the exposure device 14 is an LED image bar at a wavelength of 780 nm that is capable of forming a latent image at a resolution of 600 dpi.

The developing device 16 used in this Example is a device equipped with a metal sleeve for two-component magnetic brush development that allows reversed development. The charging amount of the toner when the developer 1 is filled in the developing device is approximately −5 to −30 μC/g.

The light source 53 in the coloring information providing device 28 is an LED image bar capable of emitting lights at peak wavelengths of 405 nm (exposure amount: 0.2 mJ/cm$^2$), 532 nm (exposure amount: 0.2 mJ/cm$^2$), and 657 nm (exposure amount: 0.4 mJ/cm$^2$) at a resolution of 600 dpi.

The transfer device 18 has, as a transfer roll, a semiconductive roll having a conductive elastomer coated on the external surface of a conductive core material. The conductive elastomer is a non-compatible blend of NBR and EPDM containing additionally two kinds of carbon blacks, Ketjen black and thermal black, dispersed therein. The conductive elastomer has a roll resistance of $10^{8.5}$ Ωcm and an Asker C hardness of 35.

The fixing device 22 used in this Example is the fixing unit in DPC1616 manufactured by Fuji Xerox Co., Ltd., and is placed at a distance of 30 cm from the point of providing coloring information. The photoirradiation device 24 used in this Example is a high-brightness schaukasten including the three wavelengths of the coloring information providing device and having an irradiation width of 5 mm.

The printing condition for the image-forming apparatus with the configuration above is as follows:

Photoreceptor linear velocity: 10 mm/sec.

Charging condition: A voltage of −400 V is applied to the Scorotron screen while a direct current of −6 kV is applied to the wire.

The surface electric potential of the photoreceptor then is −400 V.

Exposure Condition:

Exposure is conducted based on the logical sum of M-color image information, and the electric potential after exposure is approximately −50 V.

Development Bias:

A rectangular wave of alternate current at Vpp 1.2 kV (3 kHz) is superposed on a direct current at −330 V Developer Contact Condition:

The peripheral speed ratio (developing roll/photoreceptor) is 2.0; the development gap is 0.5 mm; the developer weight on developing roll is 400 g/m$^2$; and the amount of the developed toner on the photoreceptor (for M-colored solid image) is 5 g/m$^2$.

Transfer bias: Direct current of +800 V.

Fixing temperature: Fixing roll surface temperature of 180° C.

Photoirradiation device illuminance: 130,000 lux.

In the image-forming apparatus in the configuration above, an M-colored solid image at 100% density is formed continuously on 10,000 sheets of A4-sized recording medium. As a result, there is no staining in M color in the region (background region) on the recording medium 26 where the image should not be formed when visually observed even after the continuous image formation on the 10,000 sheets. It is thus confirmed that the image-forming apparatus according to an aspect of the present invention may suppress toner fogging on the recording medium.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An image-forming apparatus comprising:

an image carrier;

a charging unit that charges the image carrier to a predetermined electric potential;

a latent image forming unit that forms an electrostatic latent image corresponding to image data on the image carrier by exposing the image carrier charged by the charging unit to light;

a developing unit that stores a toner develops the electrostatic latent image formed on the image carrier with the toner, and forms a toner image on the image carrier, the toner maintaining a non-color-developing state when provided with coloring information through exposure to light;

a coloring information providing unit that provides the toner image with coloring information by exposing the toner image to light having a predetermined wavelength determined depending on a color not to be developed based on color component information of the image data;

a transfer unit that transfers the toner image onto a recording medium;

a fixing unit that fixes the toner image on the recording medium;

a color-developing unit that develops a color of the toner image provided with the coloring information; and a control unit that controls the coloring information providing unit to expose a background region on the image carrier to light having a predetermined wavelength for preventing color development of the toner, the background region being a region other than an image region that the toner image is formed on.

2. The image-forming apparatus according to claim 1, wherein the image data includes size information indicating a size of the recording medium that the image corresponding to the image data is to be formed on, and the control unit controls the coloring information providing unit to identify a region other than the image region in an area having a size specified in the size information contained in the image data as the background region on the image carrier, and to expose the background region to light having a predetermined wavelength for preventing color development of the toner in the background region.

3. The image-forming apparatus according to claim 1, wherein the toner becomes unable to develop a color determined depending on a wavelength of light when exposed to the light in a predetermined light amount or more by the coloring information providing unit, and the control unit controls the coloring information providing unit to expose the background region to the light in the predetermined light amount or more.

4. The image-forming apparatus according to claim 1, wherein the control unit controls the coloring information providing unit to expose the background region to light having a predetermined wavelength for preventing development of a color that is substantially same as a color of the image region.

5. The image-forming apparatus according to claim 1, wherein the color-developing unit is installed integrally with the fixing unit.

6. The image-forming apparatus according to claim 1, further comprising a post-fixing photoirradiation unit that irradiates light to the recording medium after fixation.

7. The image-forming apparatus according to claim 1, wherein the toner contains a first component and a second component that are present separately from each other and develop color when reacted each other, and a photocurable composition containing either one of the first component and the second component, and the toner maintains a non-color-developing state when the photocurable composition maintains a cured or uncured state by receiving the coloring information through exposure to light.

8. The image-forming apparatus according to claim 1, wherein the coloring information providing unit includes three irradiating subunits that prohibit color development of yellow, magenta, and cyan colors, respectively.

9. The image-forming apparatus according to claim 1, wherein the color-developing unit is a light-emitting apparatus or a pressure-applying apparatus.

10. The image-forming apparatus according to claim 1, wherein the coloring information providing unit gives an exposure amount of about 0.05 to about 0.8 $mJ/cm^2$.

11. The image-forming apparatus according to claim 6, wherein the post-fixing photoirradiation unit irradiates the toner with light at an intensity of about 2,000 to about 200,000 lux for about 0.5 to about 60 seconds.

* * * * *